US008562761B2

(12) United States Patent
Gunnarsson et al.

(10) Patent No.: US 8,562,761 B2
(45) Date of Patent: Oct. 22, 2013

(54) STEEL

(75) Inventors: Staffan Gunnarsson, Uddeholm (SE); Anna Medvedeva, Hagfors (SE)

(73) Assignee: Uddeholms AB, Hagfors (SE)

( * ) Notice: Subject to any disclaimer, the term of this patent is extended or adjusted under 35 U.S.C. 154(b) by 251 days.

(21) Appl. No.: 12/920,032

(22) PCT Filed: Mar. 17, 2009

(86) PCT No.: PCT/SE2009/050269

§ 371 (c)(1),
(2), (4) Date: Aug. 27, 2010

(87) PCT Pub. No.: WO2009/116933

PCT Pub. Date: Sep. 24, 2009

(65) Prior Publication Data

US 2011/0000587 A1 Jan. 6, 2011

(30) Foreign Application Priority Data

Mar. 18, 2008 (SE) ..... 0800627

(51) Int. Cl.
*C22C 38/44* (2006.01)
*C22C 38/46* (2006.01)

(52) U.S. Cl.
USPC ..... 148/335; 420/109; 420/87; 148/328

(58) Field of Classification Search
USPC ..... 148/328, 326, 336, 331, 320, 333–335; 420/109, 87
See application file for complete search history.

(56) References Cited

U.S. PATENT DOCUMENTS

| | | | | | |
|---|---|---|---|---|---|
| 3,165,402 | A | * | 1/1965 | Finkl | 420/109 |
| 3,366,471 | A | * | 1/1968 | Matas et al. | 420/8 |
| 3,912,553 | A | * | 10/1975 | Waid et al. | 148/328 |
| 6,478,898 | B1 | * | 11/2002 | Sera et al. | 148/500 |

FOREIGN PATENT DOCUMENTS

| | | | | |
|---|---|---|---|---|
| JP | S50-13809 | | | 10/1975 |
| JP | S54-56913 | | | 5/1979 |
| JP | 358123860 | A | * | 7/1983 |
| JP | 363203751 | A | * | 8/1988 |
| JP | 2000-001735 | | | 1/2000 |
| JP | 2001-089826 | | | 4/2001 |
| JP | 2001-158937 | | | 12/2001 |
| SU | 326241 | | | 1/1972 |
| WO | WO 03/069004 | | | 8/2003 |

OTHER PUBLICATIONS

English-hand translation of Japanese patent 63203751, Toshimitsu Fujii et al., Aug. 23, 1988.*

(Continued)

*Primary Examiner* — Deborah Yee
(74) *Attorney, Agent, or Firm* — Thomas & Karceski, PC

(57) ABSTRACT

Steel is described having a chemical composition, in weight-%, of 0.3 to 0.5% carbon (C), from traces to a max. of 1.5% silicon (Si), 0.2 to 1.5% manganese (Mn), 0.01 to 0.2% sulfur (S), 1.5 to 4% chromium (Cr), 1.5 to 5% nickel (Ni), 0.5 to 2% molybdenum (Mo), which at least partially may be replaced by twice as much tungsten (W), 0.2 to 1.5% vanadium (V), from traces to a max. of 0.2% rare earth metals, and a balance essentially of only iron, impurities and accessory elements in normal amounts. In addition, a method for manufacturing a blank of the steel and a process for manufacturing a cutting tool body or holder for cutting tools of the steel is described.

17 Claims, 18 Drawing Sheets

(56) References Cited

OTHER PUBLICATIONS

English-hand translation of Japanese patent 358123860 A, "Hot Working Tool Steel", Ito, Kazuo et al., Jul. 23, 1983.*
International Search Report for PCT/SE2009/050269, dated Jun. 12, 2009.
"Värmebehandling av verktygsstal," [online] utgava: 4, Dec. 2005 [retrieved on Sep. 10, 2008], Retrieved from the Internet http://www.uddeholm.se/swedish/files/Varmebehandling. swedish_051205.pdf the whole document (Dec. 2005).
"Heat Treatment of Tool Steel," Edition 6, published by Uddeholm Tooling, obtained from the Internet on Aug. 26, 2010 at http://www.uddeholm.com/files/heattreatment-english.pdf (Dec. 2007).
Office Action dated Jan. 15, 2013, in corresponding Russian Patent Application No. 9-8389.
Office Action dated Jul. 2, 2013, in corresponding Israeli Patent Application No. 71953.
Rejection Notice dated Jul. 30, 2013, in corresponding Japanese Patent Application No. 2011-500734.

* cited by examiner

STEEL

CROSS-REFERENCE TO RELATED APPLICATION(S)

This is a National Stage Entry into the United States Patent and Trademark Office from International PCT Patent Application No. PCT/SE2009/050269, having an international filing date of 17 Mar. 2009, which relies for priority on Swedish Patent Application No. 0800627-2, filed on 18 Mar. 2008, the contents of both of which are incorporated herein by reference.

TECHNICAL FIELD

The invention relates to a steel, a process for the manufacture of a blank of the steel and a process for the manufacture of a component of the steel. In the first place, the steel is intended for the use in applications requiring good hot work properties. The steel is intended for cutting tool bodies, in the first place, but also for holders for cutting tools. It may also be suitable for use in other applications with increased or moderately increased working temperatures, e.g. for hot work tools and plastic moulding tools. Examples of hot work tools are tools for forging presses and forging dies as well as die casting tools, extrusion dies and mandrels especially for light metals and copper. Examples of plastic moulding tools are moulds for injection moulding of plastics, and dies for the manufacture of profiles. Further, the material is suitable in applications where the use takes place at or below normal room temperature, for instance for engineering parts which are subject to high stresses, such as transmission shafts and gear wheels, where there are high requirements for the toughness of the material, and in applications where there are extreme requirements relating to chipping.

BACKGROUND OF THE INVENTION

The term cutting tool body means the body on or in which the active tool portion is mounted at the cutting operation. Typical cutting tool bodies are milling and drill bodies, which are provided with active cutting elements of high speed steel, cemented carbide, cubic boron nitride (CBN) or ceramic. The material in such cutting tool bodies usually is steel, within the art designated holder steel. Many types of cutting tool bodies have a very complicated shape and often there are small threaded holes and long, small drilled holes, and therefore the material must have a good machinability. The cutting operation takes place at ever increasing cutting speeds, which implies that the cutting tool body may become very hot, and therefore it is important that the material has a good hot hardness and resistance to softening at elevated temperatures. To withstand the high pulsating loads which certain types of cutting tool bodies are subject to, such as milling bodies, the material must have good mechanical properties, including a good toughness and fatigue strength. To improve the fatigue strength, compressive stresses may be introduced in the surface of the cutting tool body, and the material must therefore have a good ability to maintain said applied compressive stresses at high temperatures, i.e. the material must have a good resistance against relaxation. Certain cutting tool bodies are tough hardened, while the surfaces against which the cutting elements are applied are induction hardened, and therefore the material shall be possible to induction harden. Certain types of the cutting tool bodies, such as certain drill bodies with soldered cemented carbide tips, are coated with PVD or subjected to nitriding after hardening in order to increase the resistance against chip wear in the chip flute and on the drill body. The material shall therefore be possible to coat with PVD or to subject to nitriding on the surface without any significant reduction of the hardness.

Besides the above mentioned properties, the steel should preferably also have any of the following properties:

- good tempering resistance;
- good ductility;
- good machinability also in hardened and tempered condition;
- good hardenability with the possibility to air hardening;
- good wear resistance, above all against chip wear, so called abrasive wear;
- good resistance against chipping;
- good dimension stability during heat treatment and in use at an increased working temperature;
- good weldability;
- be possible to subject to nitriding in order to increase the hardness; and
- offer good production economy, both to the manufacturer of the steel and the holder tool, as well as to the end user.

Today, low and medium alloyed tool engineering steels are chiefly used as material for cutting tool bodies. A more high-alloyed steel for milling bodies is known through WO 97/49838. The compositions of a number of known holder steels for cutting tools are shown in the table below. Besides the elements mentioned in the table, which are indicated in weight-%, the steels contain only iron as well as impurities and accessory elements.

TABLE 1

| Steel | C, % | Si, % | Mn, % | P, % | S, % | Cr, % | Ni, % | Mo, % | V, % | Cu, % | Al, % | N, % |
|---|---|---|---|---|---|---|---|---|---|---|---|---|
| A | 0.38 | 0.21 | 0.62 | 0.010 | 0.02 | 0.69 | 1.75 | 0.19 | 0.001 | 0.19 | 0.020 | 0.009 |
| B | 0.36 | 0.18 | 0.62 | <0.01 | 0.03 | 1.56 | 1.51 | 0.16 | 0.006 | 0.18 | 0.008 | 0.013 |
| C | 0.38 | 0.26 | 1.30 | 0.013 | 0.004 | 1.81 | 0.13 | 0.15 | 0.01 | 0.12 | 0.022 | 0.006 |
| D | 0.45 | 0.17 | 0.67 | 0.017 | 0.01 | 0.91 | 0.41 | 0.87 | 0.10 | 0.11 | 0.031 | |
| E | 0.37 | 0.27 | 0.72 | 0.022 | 0.01 | 0.76 | 1.80 | 0.15 | 0.006 | 0.12 | 0.025 | 0.006 |
| F | 0.37 | 0.49 | 0.32 | 0.010 | 0.03 | 5.03 | 0.13 | 1.22 | 0.94 | 0.048 | 0.022 | 0.025 |
| G | 0.41 | 0.16 | 0.73 | 0.008 | 0.004 | 1.05 | 0.05 | 0.17 | 0.005 | 0.2 | | |
| H | 0.41 | 0.19 | 0.69 | 0.075 | 0.027 | 0.71 | 2.22 | 0.2 | 0.004 | 0.13 | | 0.009 |
| I | 0.57 | 0.22 | 0.8 | 0.01 | 0.013 | 1.0 | 1.5 | 0.5 | 0.09 | 0.1 | | |
| J | 0.41 | 0.28 | 0.7 | 0.02 | 0.009 | 0.8 | 1.6 | 0.2 | 0.09 | 0.1 | | |
| K | 0.40 | 0.20 | 0.65 | 0.011 | 0.008 | 0.64 | 1.73 | 0.15 | 0.005 | 0.14 | 0.013 | 0.006 |
| L | 0.38 | 0.28 | 1.39 | 0.012 | 0.0046 | 1.93 | 0.10 | 0.15 | 0.007 | 0.046 | 0.006 | 0.008 |
| M | 0.41 | 1.02 | 0.38 | 0.011 | 0.03 | 5.2 | 0.11 | 1.28 | 0.98 | 0.07 | | |

DISCLOSURE OF THE INVENTION

The invention provides a steel which is extremely suitable to be used as material for cutting tool bodies. The steel has appeared to fulfill the ever increasing requirements for material properties raised by cutting tool manufacturers and cutting tool users. For instance, the steel has proved to have an improved machinability, wear resistance and hardenability. Thanks to the very good property profile of the steel it is also possible to use the steel for hot work tools, plastic moulding tools as well as for engineering parts which are subject to high stresses. Preliminary tests also indicate that the steel may be suitable for use in applications where a good resistance against chipping is critical at low temperatures, i.e. from room temperature and down to −40 to −50° C., in the first place thanks to the steel maintaining a good toughness also at low temperatures. The invention relates also to a process for the manufacture of a blank of the steel as well as to a process for the manufacture of a cutting tool body or a holder for a cutting tool.

The composition of the steel is indicated in the appending claims. Below the importance of the separate elements and their interaction with each other is explained. All percentages for the chemical composition of the steel relate to weight-%.

Carbon is to be present in a minimum content of 0.20%, preferably at least 0.25%, preferably at least 0.28% so that the steel will get the desired hardness and resistance. Carbon also contributes to a good wear resistance by forming MC-carbides, where M is vanadium, in the first place. In case the steel also contains other strong carbide formers, such as niobium, titanium and/or zirconium, the MC-carbides may also contain these elements. Also molybdenum and chromium tend to form carbides but in the steel of the invention the composition has been optimized to avoid or at least minimize the presence of other carbides than MC-carbides. At high carbon contents the steel will become too hard and brittle. The carbon content shall therefore not exceed 0.5%. Preferably, the carbon content is limited to 0.40% and even more preferred the carbon content is limited to 0.32%. Nominally the steel contains 0.30% C.

Silicon is present in the steel in a dissolved form and contributes to increase the carbon activity and gives in this way the steel a desired hardness. Silicon shall therefore be present in contents from 0.10% to max. 1.5%. Preferably, the steel should contain at least 0.30%, and even more preferred at least 0.40% Si. With higher contents, a displacement of the secondary hardening towards lower temperatures has been observed. If priority is given to good hot work properties, the steel should therefore contain max. 1.0%, more preferred max. 0.80%, and most preferred max 0.60% Si. Nominally the steel contains 0.50% Si.

Silicon may also be present in the steel in a bound state in the form of silicon calcium oxides, in those cases where the steel is alloyed with calcium and oxygen, and even better as silicon calcium aluminium oxides, in those cases where the steel is also alloyed with aluminium, which in a positive way contributes to improving the machinability in the material, especially at high cutting speeds. The machinability may also be further improved if said oxides are modified by sulphur, which together with manganese form manganese sulphides which may encapsulate the oxide and function as a lubricating film at cutting operation of the steel at lower cutting speeds.

Manganese contributes to improving the hardenability of the steel and together with sulphur manganese contributes to improving the machinability by forming manganese sulphides. Manganese shall therefore be present in a minimum content of 0.20%, preferably at least 0.60%, and more preferred at least 1.0%. At higher sulphur contents manganese prevents red brittleness in the steel. The steel shall contain max. 2.0%, preferably max. 1.5%, and even more preferred max. 1.3% Mn. An optimal manganese content is 1.2%.

Sulphur contributes to improving the machinability of the steel and shall therefore be present in a minimal content of 0.01%, more preferred at least 0.015% to give the steel an adequate machinability. At higher sulphur contents there is a risk for red brittleness, which cannot be entirely compensated for by correspondingly high manganese content.

Moreover, at higher contents sulphur has a negative effect on the fatigue properties of the steel. The steel shall therefore contain max. 0.2%, preferably max. 0.15%, and even more preferred max. 0.1% S. A suitable sulphur content is in the range of 0.025 to 0.035% S. A nominal sulphur content is 0.030%.

In applications which do not require a good machinability, e.g. hot work steels exposed to high stresses, it is desirable that the sulphur content is kept as low as possible. In that case, no intentional addition of sulphur is made, which implies that sulphur shall not be present in contents above trace contents. In addition, if the steel is manufactured in very large dimensions, an Electro Slag Remelting (ESR) may be performed in order further to remove impurities, i.a. sulphur.

Chromium shall be present in the steel in an amount between 1.5 and 4.0% in order to give the steel good hardenability. Further, chromium may form carbides together with carbon, which improves the wear resistance. The carbides, in the first place of $M_7C_3$-type, are precipitated essentially as secondary precipitated sub-microscopic particles at high temperature tempering of the steel and contributes to the steel obtaining a good tempering resistance. Preferably, the steel contains at least 1.90% and even more preferred at least 2.20% Cr. At higher contents of chromium, the temper resistance and the machinability of the steel are impaired, which is a drawback, especially when the steel is used for cutting tool bodies and other hot work applications. For this reason, it is an advantage if the chromium content is limited to 3.0%, and more preferred to 2.5%. A nominal chromium content is 2.30% Cr.

Nickel is present in a dissolved form in the steel and improves the machinability of the steel and gives the steel a good hardenability, toughness and hot hardness. To reach necessary hardenability for the cutting tool bodies, the steel shall contain at least 1.5% Ni. When there are higher requirements for hardenability, the nickel content may be increased. A certain improvement is reached at 2.0% Ni, and if the nickel content is increased to 3.0%, a very good hardenability is obtained, which allows that comparatively large dimensions may be hardened by cooling in air, which is advantageous. At a nickel content of 4.0%, tests have proved that the steel obtains an extremely good hardenability, which in practice implies that the steel obtains an entirely martensitic matrix, without any risk for either perlite or bainite, in spite of very slow cooling of work pieces of a dimension up to Ø1000 mm. Nickel also is an austenite stabilizing element and to avoid or at least minimize the amount of retained austenite in hardened and tempered condition, the nickel content is limited to max. 5.0%, preferably max. 4.5%. Because of the expense, the nickel content of the steel should be limited as far as possible, however without impairing the properties aimed at. A preferred range is 3.80-4.10% Ni. A nominal nickel content is 4.00%.

Molybdenum has lately become a very expensive alloying metal and many steels on the market have become considerably more expensive to manufacture because of this. Because of the expense, many people has lately tried to limit the use of molybdenum, but its very favourable effect on the hardenability of the steel and its influence on the tempering resistance and hence the hot hardness has hitherto prevented this limitation. Very surprisingly, it has been proved that the steel of the invention obtains a property profile which is favourable for the applications of interest in spite of the comparatively low content of molybdenum. The minimum molybdenum content may be as low as 0.5%, but preferably the steel contains at least 0.7% Mo.

Molybdenum is a carbide forming element. Depending on the variation of the composition of the steel within the specified ranges, up to 2 vol.-% of molybdenum rich primary carbides of the type $M_6C$ may be precipitated in the matrix of the steel. These carbides are somewhat more difficult to dissolve in connection with the hardening than e.g. MC-carbides, and do not have the same favourable effect on the property profile of the steel, and, in a preferred embodiment, it is desirable to minimize the occurrence of these $M_6C$-carbides. Without departing from the requirement on machinability the steel may be allowed a content of 2.0% Mo. At this content a very good wear resistance and hot hardness is obtained. Because of the expense, the molybdenum content should, however, not exceed 1.0%, and a preferred range is 0.75 to 0.85% Mo. Nominally, the steel contains 0.80% Mo. In principle, molybdenum may at least to a certain extent be replaced by twice as much tungsten. Tungsten is, however, a very expensive alloy metal and it also complicates the handling of scrap metal.

Cobalt should for the same reason as tungsten not be present in the steel but may be tolerated in contents up to max 1.0%, preferably max. 0.20%. Cobalt contributes to increasing the hardness of the martensite and gives an increased hot hardness, and for that reason the machinability in hardened and tempered condition may be impaired. Possibly, the hardness increasing effect of cobalt may be used to reduce the austenitizing temperature at the hardening, which may be an advantage.

Vanadium is favourable for the tempering resistance and the wear resistance of the steel, as it together with carbon form up to about 3.5 vol.-%, preferably max. 2 vol.-% of comparatively round, evenly distributed primary precipitated MC-carbides in the matrix of the steel. Vanadium shall therefore be present in a minimum content of 0.20%, preferably at least 0.60%, and more preferred at least 0.70%. In connection with the hardening, a dissolving of said carbides takes place, and depending on the chosen austenitizing temperature essentially all primarily precipitated MC-carbides may be dissolved, which is aimed at in a preferred embodiment of the steel. At the subsequent tempering, very small vanadium-rich so called secondary carbides of MC-type are precipitated instead. In a preferred embodiment, the steel is thus characterized in that it has a matrix comprising tempered martensite, which is essentially free from primary carbides of the MC-type but with a certain occurrence of very small, evenly distributed secondarily precipitated MC-carbides. Within the scope of the invention, the steel may, however, be permitted a certain content of primarily precipitated MC-carbides in the hardened and tempered condition. In order not to impair the machinability of the steel, the vanadium content should not exceed 1.50%, more preferred not exceed 1.00%, and most preferred not exceed 0.90%. Nominally the steel contains 0.80% V.

Niobium forms primary carbides which are difficult to dissolve and shall be presents in contents of max. 0.5%. Preferably, niobium should not be present in amounts above impurity contents, i.e. max. 0.030%. Also titanium, zirconium, aluminum, and other strong carbide formers constitute non-desirable impurities and shall therefore not be present in contents above impurity level.

In those applications where a good machinability is desired, and especially where a good machinability at high cutting speeds is desirable, it is an advantage if the steel also contains oxygen and calcium in effective amounts in order to form silicon calcium oxides together with silicon. The steel should therefore contain 10 to 100 ppm O, preferably 30 to 50 ppm O, and 5 to 75 ppm Ca, preferably 5 to 50 ppm Ca. Preferably, it is also alloyed with 0.003 to 0.020% aluminum, so that silicon calcium aluminum oxides are formed, which improve the machinability to a still greater extent than pure silicon calcium oxides. These silicon calcium aluminum oxides may advantageously be modified by sulphur, which in the form of manganese sulphides contributes also to improving the machinability at lower cutting speeds.

Rare earth metals, such as cerium, lanthanum and others, may possibly be added to the steel to give the material isotropic properties, an optimal machinability, good mechanical properties and a good hot workability and weldability. The total content of rare earth metals may amount to max. 0.4%, preferably max. 0.2%.

Copper is an element which may contribute to increasing the hardness of the steel. However, already in small amounts, copper negatively influences the hot ductility of the steel. Further, it is not possible to extract copper from the steel once it has been added. This drastically reduces the possibility to recover the steel. It requires that the scrap metal handling is adapted to sort out scrap metal containing copper to avoid that the copper content increases in steel types not being tolerant to copper. For this reason, copper shall preferably exist in the steel only as an unavoidable impurity from the scrap metal raw material.

Within the scope of the invention a possible composition for the steel according to the invention, the composition of which has been adapted also to give the steel a good machinability, may be as follows: 0.30 C, 0.50 Si, 1.20 Mn, max 0.025 P, 0.030 S, 2.3 Cr, 4.0 Ni, 0.8 Mo, max 0.20 W, max 0.20 Co, 0.8 V, max 0.005 Ti, max 0.030 Nb, max 0.25 Cu, 0.010 Al, 5-50 ppm Ca, 30-50 ppm O, balance iron.

BRIEF DESCRIPTION OF DRAWINGS

The invention will now be described in detail with reference to the enclosed drawings, of which.

TESTS PERFORMED

Figure 1:
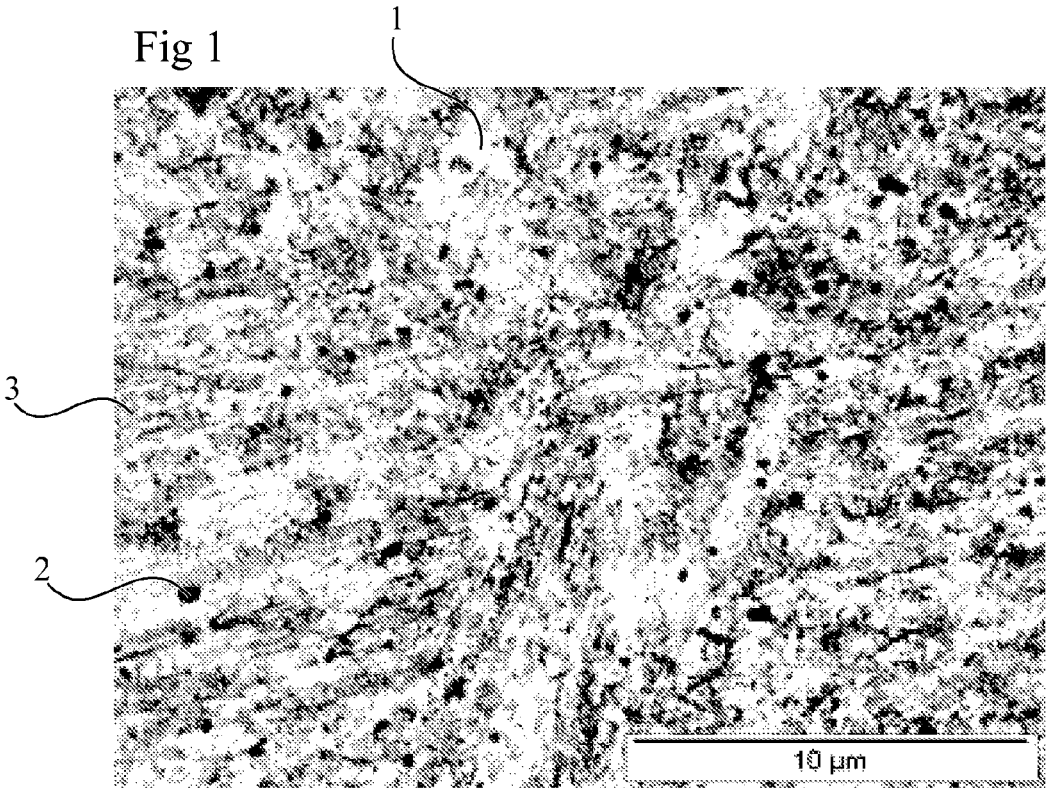
FIG. 1 shows the microstructure of the steel.

Initially, a number of milling cutter bodies were provided from various manufacturers and the compositions of the steels were analyzed. Further, it was examined whether the milling cutter bodies had been surface treated, e.g. whether they had been surface coated or shot peened as well as whether they had been hardened and tempered. The examination showed that all milling cutter bodies had compositions which are previously known. The milling cutter bodies had been manufactured in manner which is conventional for milling cutter bodies and for that reason it was concluded that the milling cutter bodies do not have any unexpected properties and thus do not fulfill those increasing requirements on properties which have arisen lately.

In order to develop a steel, which better corresponds to the new and higher property requirements, i.a. better machinability and strength properties at increased working temperatures, it was decided to produce a number of test alloys. The materials for the examination were produced both in a laboratory scale and a full scale, the compositions of which are shown in Table 2. The composition contents indicated relates to mean values of measurements at various positions of the ingots produced. In Table 2, also the compositions of a number of reference materials are shown, which are designated Nos. 1, 3, and 5, and which are commercially available. The contents indicated for the reference material are nominal contents. The contents of aluminium, nitrogen, calcium, and oxygen have not been registered. For all materials, the balance is iron, besides impurities which may occur in normal amounts together with the impurities or accessory elements indicated in the table.

Initially, six melts were produced in a laboratory scale, which were cast to laboratory ingots of 50 kg (Q9277-Q9287), wherein the melts Q9280-Q9287 are examples of the invention. The Q-ingots produced were forged to test specimens of the size 60×40 mm, which then were soft-annealed at a temperature of 850° C., 10 h, and then cooled in a furnace, 10° C./h, to 650° C., thereafter cooling freely in air to room temperature. Thereafter, they were hardened to the desired hardness.

Starting from Q9287, a melt of 6 tons was manufactured in a production scale (steel No. 6), the composition of which is shown in Table 2. The manufacturing process is described in detail further on, but briefly the production may be described as follows: Ingots were manufactured from the melt of 6 tons by conventional bottom casting. The ingots were hot rolled to bars with a size of Ø28 mm, Ø45 mm and 120×120 mm. Most bars were soft-annealed and then test specimens and milling cutter bodies were manufactured, which were hardened and tempered. Unless otherwise is stated, high temperature tempering is referred to.

Some of the bars from the melt of 6 tons were not soft-annealed. These bars were not subjected to any conventional hardening operation, as the cooling after the hot rolling operation had given the material a hardened structure. This material is designated steel No. 6a in the following description of the performed tests. Test bars were produced from these "directly hardened" bars, which test bars were tempered to the desired hardness.

Test specimens were manufactured from the reference materials, which test bars were hardened and tempered to the desired hardness according the manufacturer's instructions. Further, a number of milling cutter bodies were produced for application tests.

TABLE 2

| Steel No. | C | Si | Mn | P/S | Cr | Ni | Mo | V |
|---|---|---|---|---|---|---|---|---|
| Q9277 | 0.38 | 0.94 | 0.86 | 0.012/0.027 | 4.74 | 0.06 | 1.24 | 0.9 |
| Q9278 | 0.35 | 0.92 | 0.91 | 0.013/0.028 | 4.78 | 0.07 | 0.2 | 0.81 |
| Q9279 | 0.28 | 0.30 | 0.96 | 0.013/0.031 | 2.07 | 0.07 | 1.92 | 0.87 |
| Q9280 | 0.28 | 0.12 | 0.68 | 0.010/0.032 | 1.90 | 2.81 | 1.99 | 0.75 |
| Q9286 | 0.28 | 0.53 | 1.15 | 0.020/0.030 | 2.53 | 3.02 | 1.00 | 0.71 |
| Q9287 | 0.28 | 0.47 | 1.18 | 0.019/0.028 | 2.32 | 3.99 | 0.78 | 0.76 |
| 1 | 0.39 | 0.5 | 0.4 | 0.025/— | 5.3 | — | 1.3 | 0.9 |
| 3 | 0.34 | 0.3 | 0.7 | 0.025/— | 1.3 | 1.4 | 0.2 | — |
| 5 | 0.37 | 0.3 | 1.4 | 0.01/— | 2.0 | 1.0 | 0.2 | — |
| 6 | 0.31 | 0.5 | 1.2 | 0.013/0.028 | 2.2 | 4.07 | 0.76 | 0.75 |

The invention will now be explained with reference to the performed tests.

Microstructure

The microstructure of a preferred embodiment of the steel of the invention in hardened and tempered condition (steel No. 6) is shown in the photo of FIG. 1. The steel has been hardened at an austenitizing temperature of 1020° C. during 30 minutes and tempered twice during two hours with an intermediate cooling at a temperature of 600° C., (600° C./2×2 h) and obtained a hardness of 45 HRC. In the preferred embodiment the steel has a matrix consisting of tempered martensite (1) without retained austenite, perlite or bainite. As the steel is said to be without the presence of retained austenite, it should be understood that the steel may contain up to 2 vol.-% of retained austenite, as contents below 2 vol.-% are difficult to establish. The matrix has a comparatively evenly distributed content of up to about 2 vol.-% of carbides, of which about 1 vol.-% of the carbides is primarily precipitated MC- and $M_6C$-carbides (2). About 1 vol.-% of the carbides has round or substantially round form and has a size in their longest extension of max. 5 μm, preferably max. 2 μm and even more preferred max 1 μm. Said substantially round carbides are mostly MC-carbides, where M is vanadium and some molybdenum. A certain occurrence of $M_6C$-carbides may also be noticed, where M substantially is molybdenum. Besides primary carbides the steel also contains about 1 vol.-% secondary precipitated MC, $M_2C$, and/or $M_3C$ carbides (3). The major part of said secondary carbides has round or substantially round form and has a size in their longest extension of max. 20 nm. Also somewhat more elongated carbides may be noticed, which have a size in their longest extension of max. 100 nm. Said carbides contain chromium, vanadium, molybdenum as well as iron. The steel is also characterized in that there is no occurrence of grain boundary carbides. The lack of grain boundary carbides contributes to an improved machinability and toughness.

It is desirable to eliminate or at least minimize the amount of retained austenite in the material. As may be seen from FIG. 1, it is possible to eliminate the presence of retained austenite after high temperature tempering, when the steel is given a composition according to a preferred embodiment of the invention. On the other hand, if the steel is low temperature tempered, there may be a certain presence of retained austenite, typically about 3%. Further, immediately after hardening, the content of retained austenite is somewhat higher, about 4 to 6%. As a man skilled in the art may realize, the content of retained austenite may also vary depending on the balance between the austenite stabilizing elements, for this steel carbon, manganese and nickel above all, and the ferrite stabilizing elements, for this steel silicon, chromium and molybdenum above all. Said elements are to be balanced so that the austenite content in hardened and tempered condition amounts to max. 10%, and preferably max. 5%, so that the steel will fulfil the requirement for an adequate dimension stability, among other things.

Figure 18:
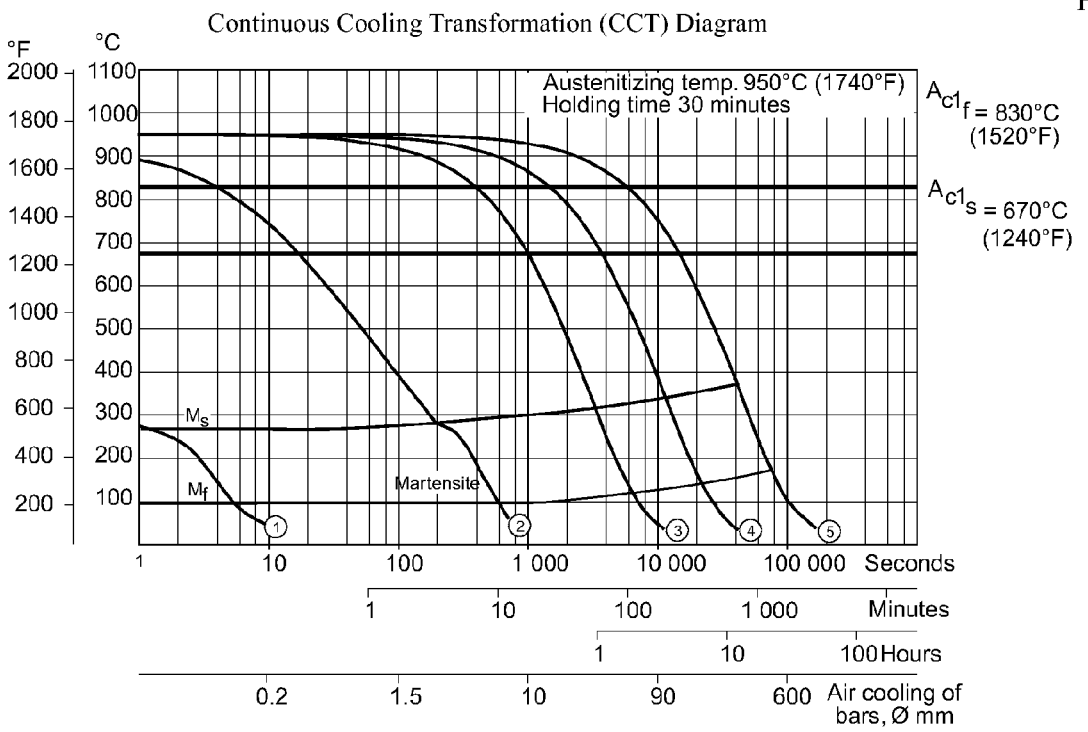
FIG. 18 is a Continuous Cooling Transformation Diagram.

In order to examine the microstructure of various dimensions a dilatometer testing was performed, i.e. cooling of austenitized test specimens at various cooling rates from 800° C. to 500° C. The steel had been austenitized at 950° C. during 30 min. The dilatometer testing indicated that the steel of the invention could obtain a microstructure in accordance with what has been described with reference to FIG. 1 for dimensions up to Ø1 m. A Continuous Cooling Transformation (CCT) diagram is presented in support for this, see FIG. 18. In the diagram, different cooling curves are shown. The data for this curves are as follows:

| Cooling Curve No. | Hardness HV 10 | T 800-500 (sec) |
|---|---|---|
| 1 | 536 | 1 |
| 2 | 514 | 43 |
| 3 | 498 | 1380 |
| 4 | 464 | 5175 |
| 5 | 446 | 20200 |

Tempering Response

Figure 2:
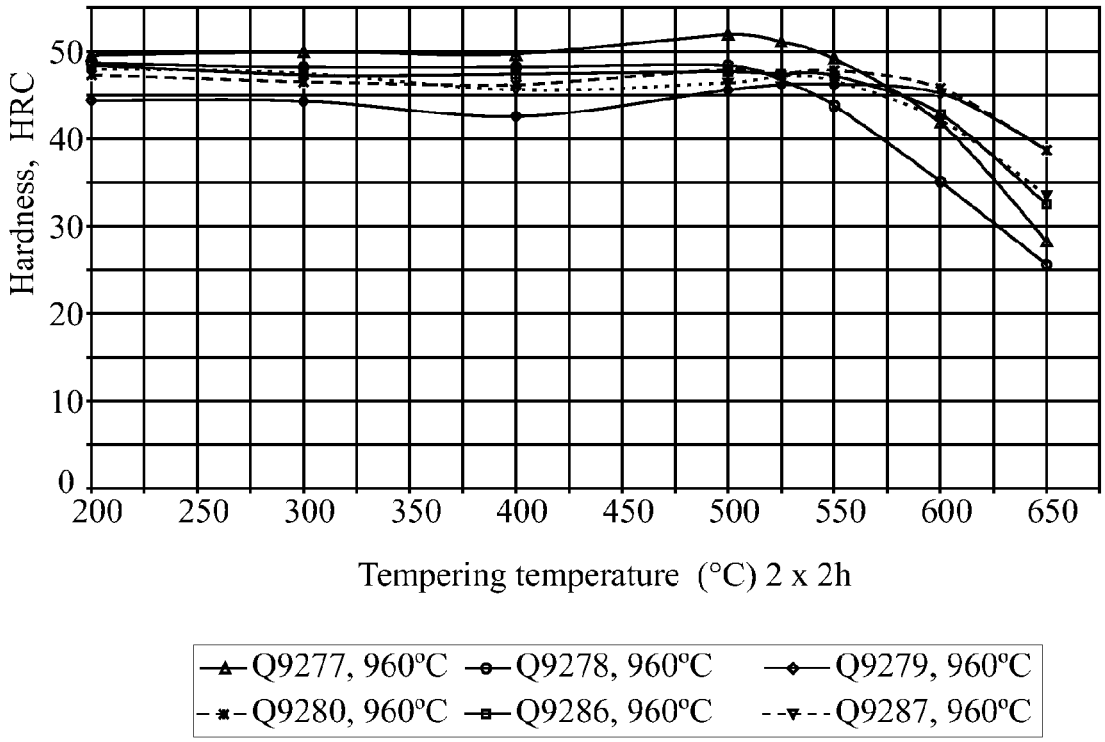
FIG. 2 is a graph showing the hardness in relation to the tempering temperature.
Figure 3:
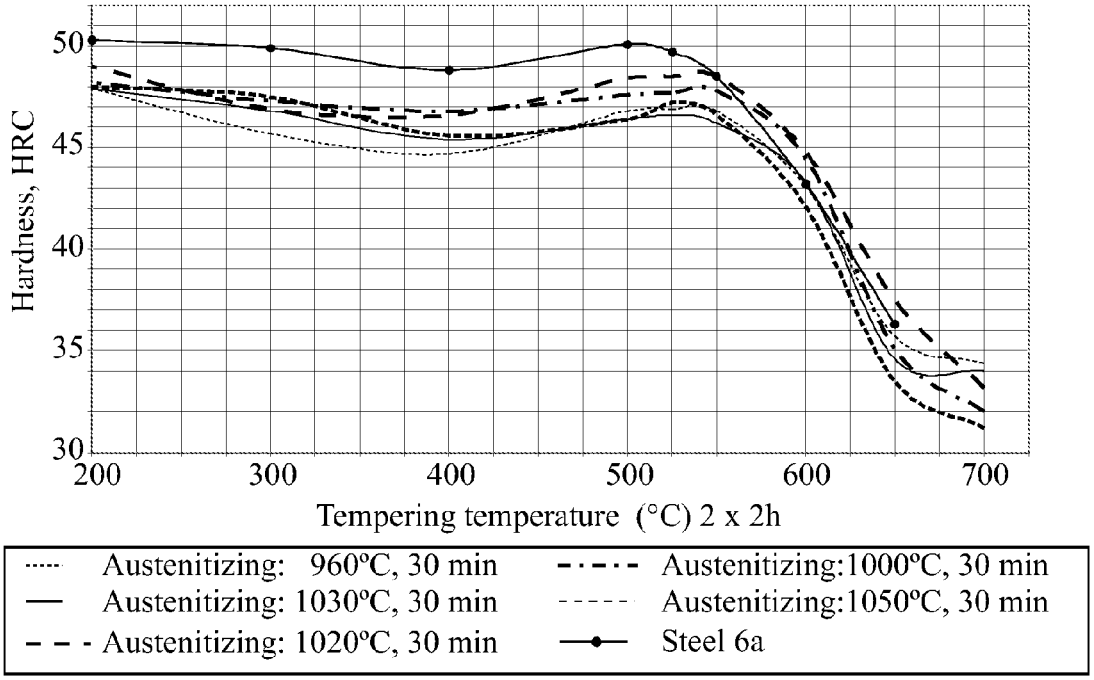
FIG. 3 is another graph showing the hardness in relation to the tempering temperature.
Figure 4:
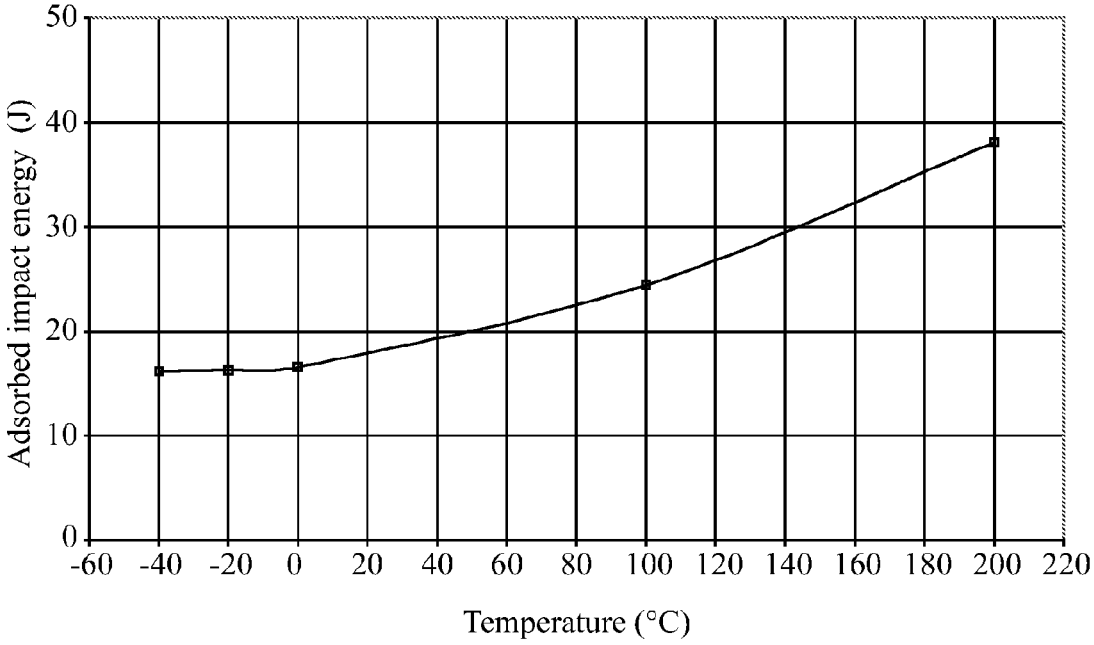
FIG. 4 is a graph showing the results from tests of impact toughness at various temperatures.

The tempering response of some of the test alloys produced was examined and the results are shown in FIGS. 2 to 4. FIG. 2 is a graph showing the hardness of the produced laboratory ingots, Q9277 to Q9287, after hardening from an austenitizing temperature of 960° C., 30 minutes, and tempering 2×2 h at various tempering temperatures. The figure shows that the materials Q9280 to Q9287 of the invention have a secondary hardening at a temperature of about 550° C., while the reference material Q9277 obtains a somewhat higher hardness while the secondary hardening occurs at a somewhat lower temperature, about 500° C. When used in hot condition, the growth of carbides is slower for the materials having a secondary hardening occurring at higher temperatures than with the materials having a secondary hardening occurring at lower temperatures. It is reflected in the fact that the materials Q9280 to Q9287 of the invention together with Q9279 also have a comparatively flat tempering curve at temperatures above 550° C., and thus have a better tempering response than the other materials.

The tempering response for steel No. 6 and steel No. 6a at various austenitizing temperatures was examined and the hardness of the steel after tempering is shown in FIG. 3. A distinct secondary hardening was measured at tempering temperatures of about 500 to 550° C. The figure shows that steel No. 6a obtained the highest hardness, while steel No. 6, which had been hardened in a conventional manner, obtained a somewhat lower hardness. It should be noticed that steel No. 6 obtained a secondary hardening at a temperature of about 550° C., while steel No. 6a obtained a secondary hardening at a temperature of about 500° C. It should also be noticed that steel No. 6a principally obtained the same tempering response as steel No. 6 at temperatures from about 550° C. up to 650° C.

Tempering Resistance

Figure 19:
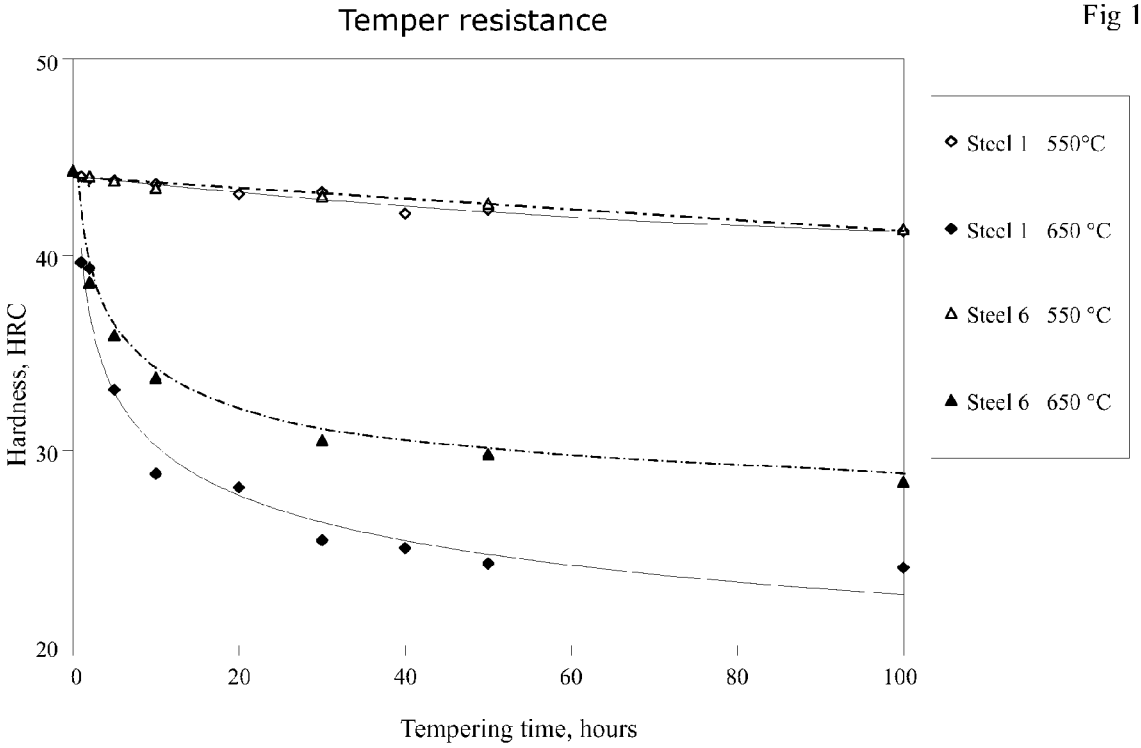
FIG. 19 is a diagram showing the temper resistance.
Figure 20:
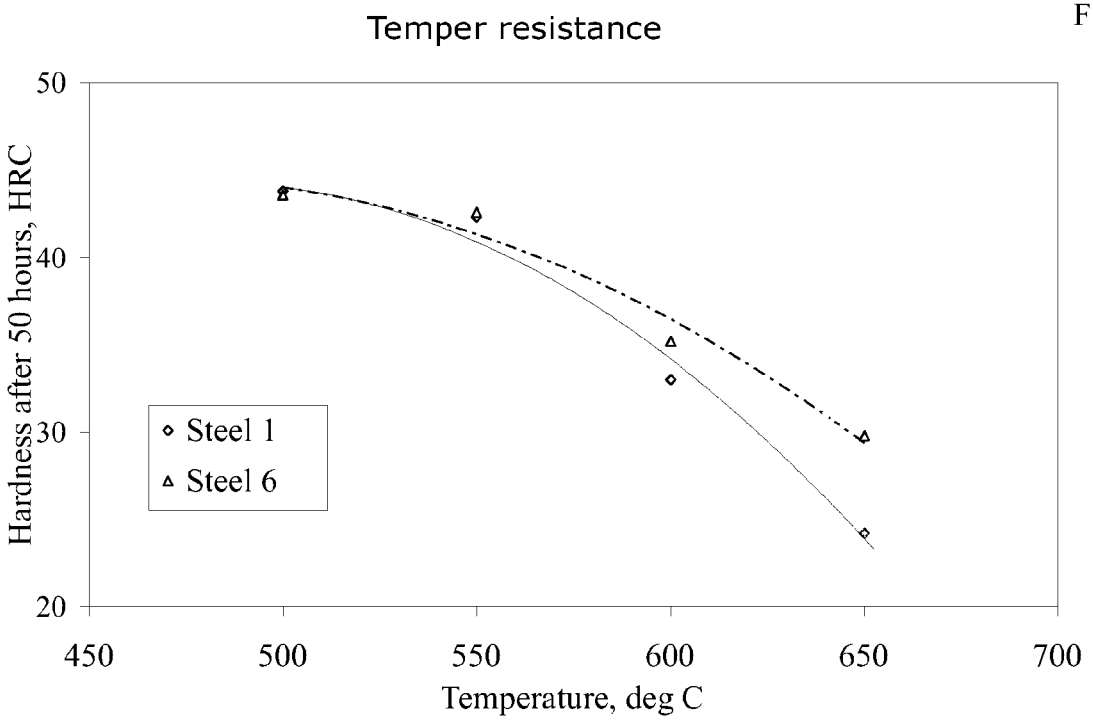
FIG. 20 is a diagram showing the temper resistance.

A comparison of the effect of time at high temperatures on hardness is shown in FIGS. 19 and 20. The steel of the invention and a reference steel are compared after tempering at 550° C. and 650° C. respectively. In FIG. 19 it can be seen that the inventive steel has a significantly better tempering resistance than the reference steel at 650° C. The same result is shown in FIG. 20, where the effect on hardness after a holding time of 50 h at various temperatures is shown. It can be seen that the inventive steel maintains its hardness better at increasing temperatures and longer times than the reference steel. The inventive steel has a tempering resistance providing a reduction in hardness of less than 15 HRC-units after heat treatment during 50 h at 500° C. and 650° C. respectively, which is very good. 50 h corresponds to the normal service life for a cutting tool body.

Impact Toughness

The impact toughness of steel No. 6 at various temperatures and at various hardnesses was examined and compared with steel No. 1 by Charpy V-tests (test process: ASTM E399/DIN EN 10045). Test specimens had been taken out from bars of various dimensions, which have resulted in various degrees of through working of the materials. As a general rule a higher degree of through working results in higher impact strength. The results are shown in Table 3 and there also the hardness of the steels is shown after hardening and tempering, the dimension of the bars from which the test specimens have been taken, the position of the test specimens in the bars, at which temperatures the test specimens have been tested and the heat treatment conditions. The impact toughness of steel No. 6 was examined also in hot rolled condition and after tempering in hot rolled condition, according to what is described above for non-soft-annealed material.

The tests showed that steel No. 6 has a better impact toughness than the reference material No. 1. Further, it was found that the toughness is best for this steel after low temperature tempering, i.e. tempering at temperatures up to max. 450 to 475° C., at the same time as the hardness of the steel is somewhat higher than after high temperature tempering. However, the same good wear resistance is not reached at low temperature tempering. In addition, it showed that the steel of the invention does not have a ductile-brittle transition temperature at temperatures below room temperature, at least not for temperatures down to −40° C. This indicates that the steel may be suitable also when there are requirements for good toughness at low temperatures.

TABLE 3

| Steel No. | Hardness (HRC) | Dimension (mm) | Position* | Impact toughness (J)/temp. (° C.) | Heat treatment |
|---|---|---|---|---|---|
| 1 | 45 | Ø45 | CR | 7.5/20 | 1020° C./30 min + 600° C./2 × 2 h. |
| 1 | 45 | Ø45 | CR | 6/−20 | 1020° C./30 min + 600° C./2 × 2 h. |
| 1 | 45 | Ø45 | CR | 5.5/−40 | 1020° C./30 min + 600° C./2 × 2 h. |
| 6 | 45 | 120 × 120 | LT | 10/20 | 1020° C./30 min + 600° C./2 × 2 h. |
| 6 | 45 | 120 × 120 | LT | 9.5/0 | 1020° C./30 min + 600° C./2 × 2 h. |
| 6 | 45 | 120 × 120 | LT | 8.5/−10 | 1020° C./30 min + 600° C./2 × 2 h. |

TABLE 3-continued

| Steel No. | Hardness (HRC) | Dimension (mm) | Position* | Impact toughness (J)/temp. (° C.) | Heat treatment |
|---|---|---|---|---|---|
| 6 | 45 | 120 × 120 | LT | 8.0/−20 | 1020° C./30 min + 600° C./2 × 2 h. |
| 6 | 45 | 120 × 120 | LT | 7.5/−40 | 1020° C./30 min + 600° C./2 × 2 h. |
| 6 | 45 | Ø45 | LC | 17.5/20 | 1020° C./30 min + 600° C./2 × 2 h. |
| 6 | 47.5 | Ø28 | LC | 21.5/20 | 1020° C./30 min + 475° C./2 × 2 h. |
| 6 | 47 | Ø28 | LC | 22.5/20 | 1020° C./30 min + 450° C./2 × 2 h. |
| 6 | 45 | Ø70 | LC | 17.8/20 | 1020° C./30 min + 600° C./2 × 2 h |
| 6 | 45 | Ø70 | LC | 17.1/0 | 1020° C./30 min + 600° C./2 × 2 h |
| 6 | 45 | Ø70 | LC | 14.9/−10 | 1020° C./30 min + 600° C./2 × 2 h |
| 6 | 45 | Ø70 | LC | 14.88/−20 | 1020° C./30 min + 600° C./2 × 2 h |
| 6 | 45 | Ø70 | LC | 14.98/−40 | 1020° C./30 min + 600° C./2 × 2 h |
| 6 | 45 | Ø70 | CR | 7.65/20 | 1020° C./30 min + 600° C./2 × 2 h |
| 6 | 45 | Ø70 | CR | 7.4/0 | 1020° C./30 min + 600° C./2 × 2 h |
| 6 | 45 | Ø70 | CR | 6.4/−10 | 1020° C./30 min + 600° C./2 × 2 h |
| 6 | 45 | Ø70 | CR | 6.5/−20 | 1020° C./30 min + 600° C./2 × 2 h |
| 6 | 45 | Ø70 | CR | 5.96/−40 | 1020° C./30 min + 600° C./2 × 2 h |
| 6a | 46 | Ø70 | LC | 6.4/20 | Hot rolled + 580° C./2 × 2 h |
| 6a | 46 | Ø70 | CR | 3.5/20 | Hot rolled + 580° C./2 × 2 h |
| 6a | 53 | Ø28 | LC | 27.5/20 | Hot rolled, not tempered |
| 6a | 51 | Ø45 | LC | 38.5/20 | Hot rolled + 200° C./2 × 2 h. |
| 6a | 46 | Ø45 | LC | 14/20 | Hot rolled + 580° C./2 × 2 h. |

Figure 21A:
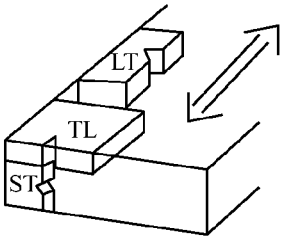
FIG. 21*a, b* shows the positions of test specimens.
Figure 21B:
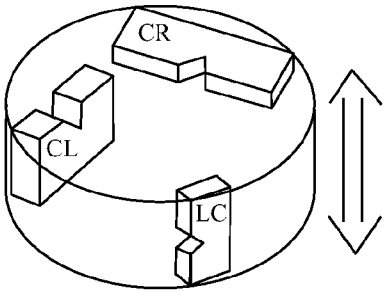

*See FIGS. 21 a, b for information of the different positions of the test specimens.

Isothermal Fatigue Strength

Figure 5:
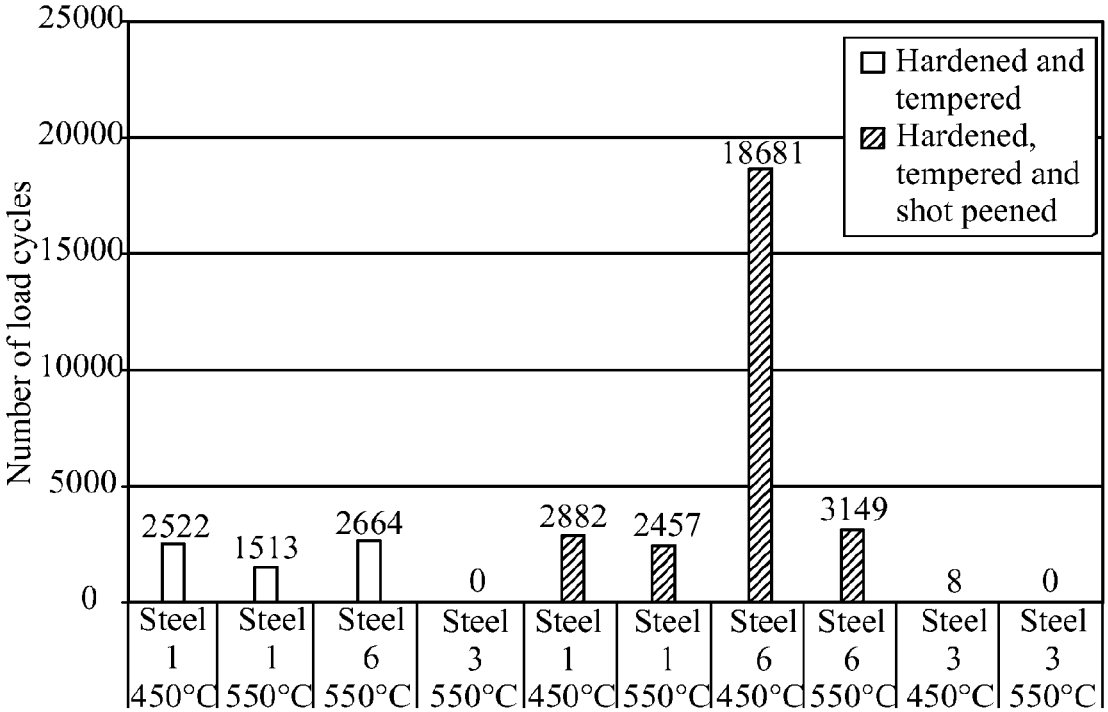
FIG. 5 is a diagram showing the fatigue life at various temperatures.

The fatigue strength of steel No. 6 at various temperatures at a holding time of 2 h was compared with the reference materials Nos. 1 and 3, which is shown in FIG. 5. The materials were examined in hardened and tempered condition. All materials were hardened and tempered to a hardness of 45 HRC. Thereafter, some of the test specimens were shot peened. Shot peening is a method for introducing compressive stresses in the surface of the material. Shot peening data:

Steel balls: Ø0.35 mm,
Hardness: 700 HV,
Pressure: 4 bars
Angle: 90°
Time: 36 s
Distance: 75±5 mm
Rotation: 37 rpm The results show that steel No. 6 has a better fatigue strength than the two reference materials. Steel No. 6 had a superior fatigue resistance in shot peened condition at 450° C., which is a working temperature which certain cutting tool bodies may reach in extreme cases.

Hot Hardness

Figure 6A:
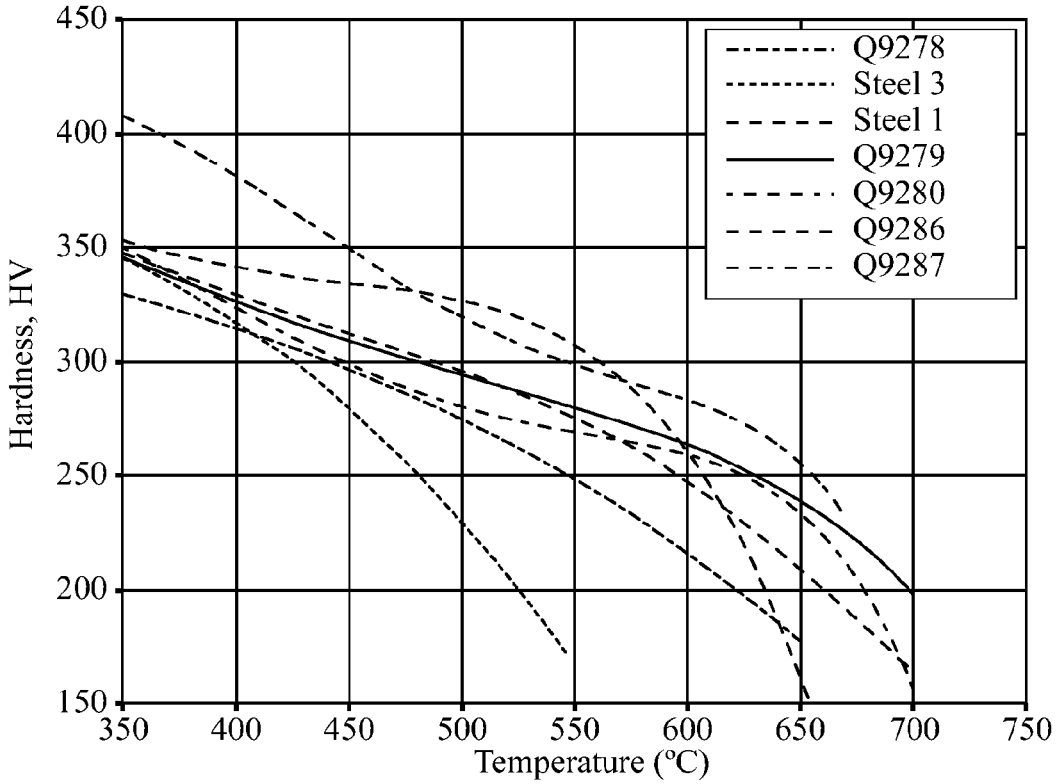
FIGS. 6*a, b* are graphs showing the hot hardness.

The hot hardness of steel No. 6 was compared with the reference materials. The steels had been hardened and tempered to a hardness of 430 HV. The exception was steel Q9287, which had a hardness of 460 HV. Initially, the test alloys manufactured at a laboratory scale were compared with the reference steels Nos. 1 and 3. The results are shown in FIG. 6*a*. The test alloys Q9280 to Q9287 had the best hot hardness, which is shown by the reduction in hardness being comparatively slow and by a heavier reduction in hardness arising at higher temperatures than for the reference materials.

Figure 6B:
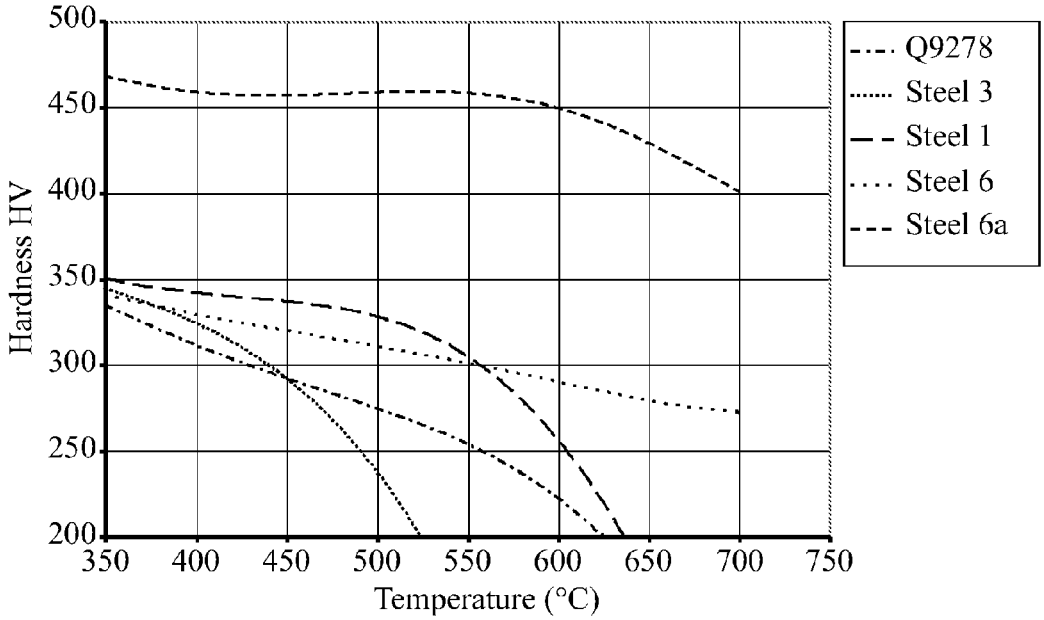

Also steel No. 6, which had been manufactured at a production scale, was compared with the reference materials, which is shown in FIG. 6*b*. Here it is even more evident that the steel of the invention has a very good hot hardness.

Stress Relieving Resistance

Figure 7:
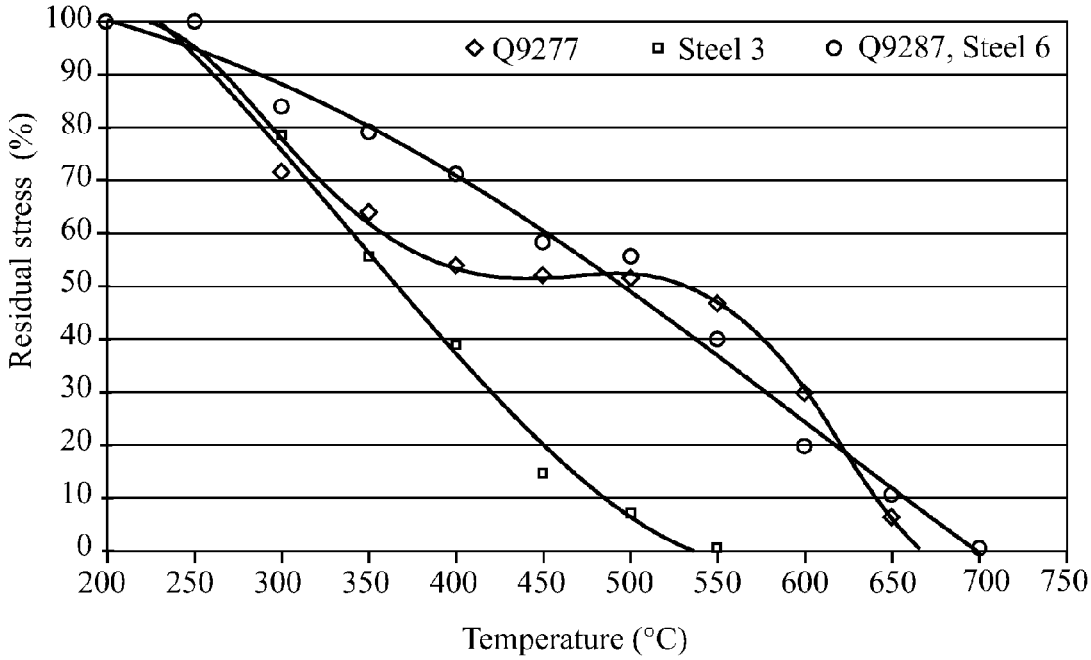
FIG. 7 is a graph showing the ability of the steel to maintain residual compressive stresses introduced to it.
Figure 8A:
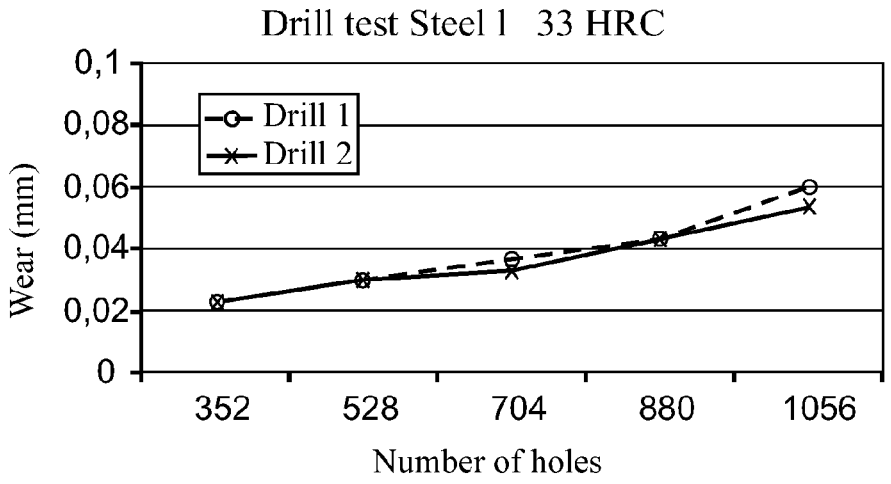
FIGS. 8*a* to *c* show results from drilling tests.
Figure 8B:
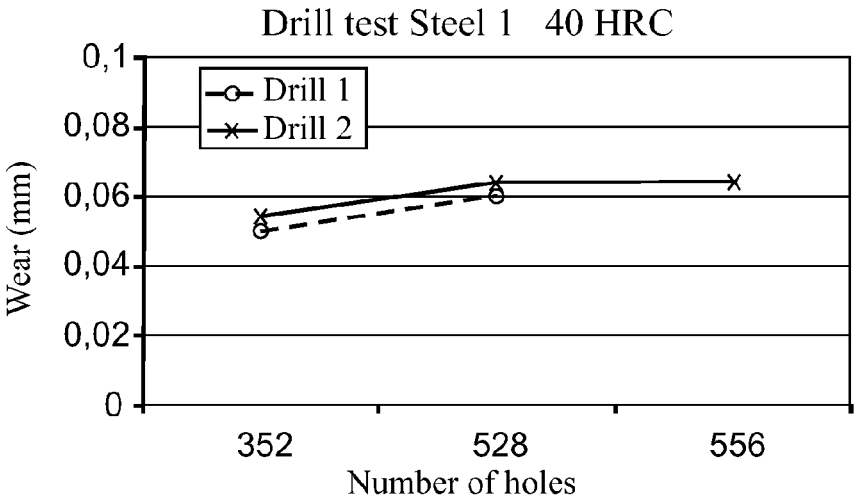
Figure 8C:
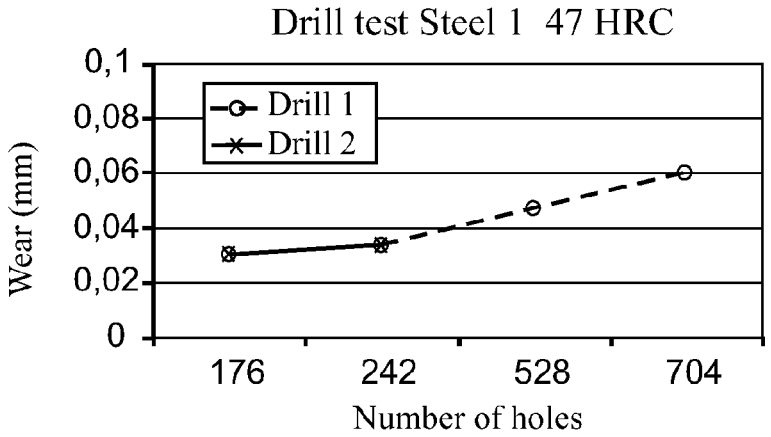
Figure 9A:
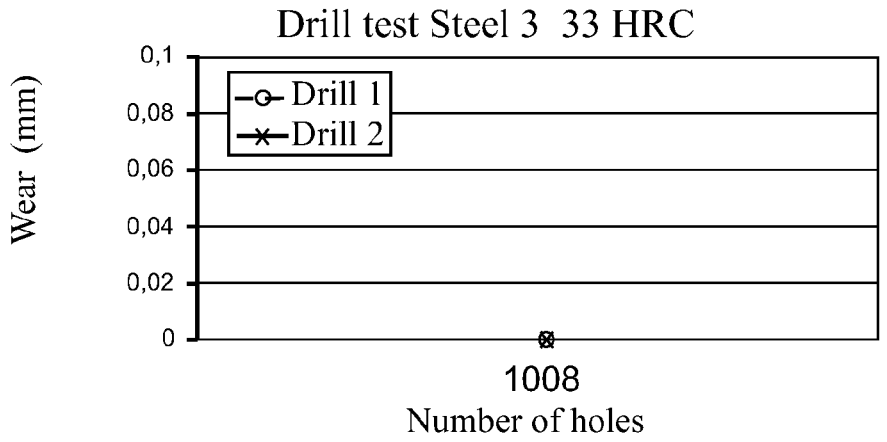
FIGS. 9*a* to *c* show results from drilling tests.
Figure 9B:
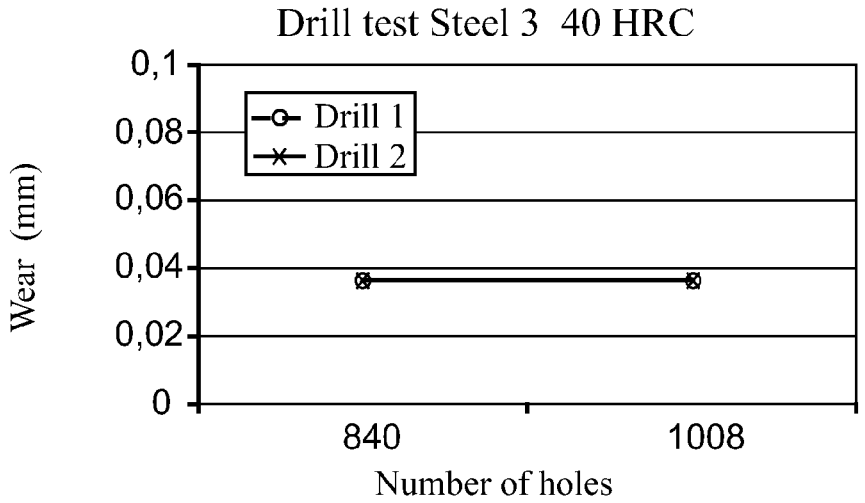
Figure 9C:
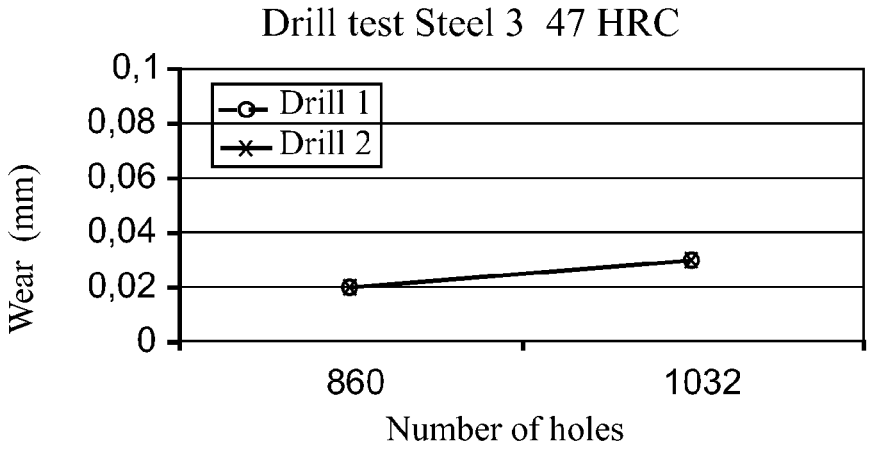
Figure 10A:
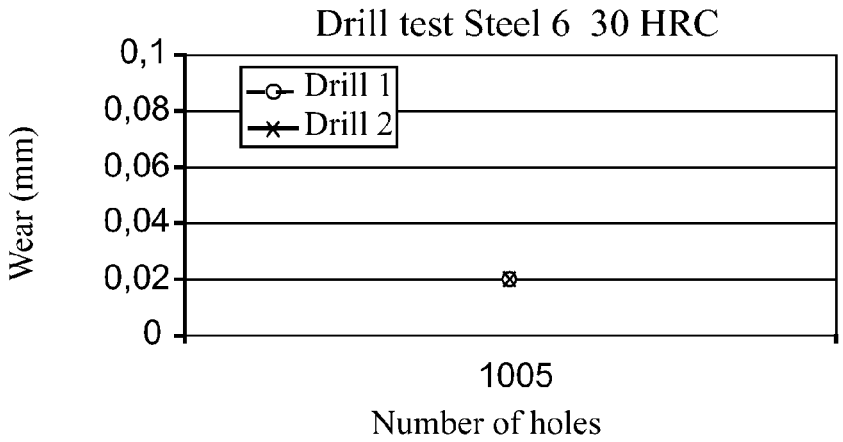
FIGS. 10*a* to *c* show results from drilling tests.
Figure 10B:
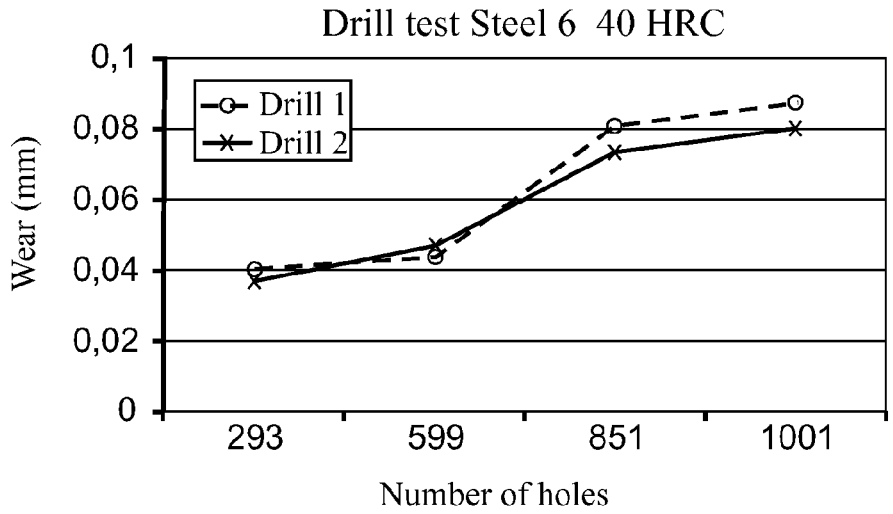
Figure 10C:
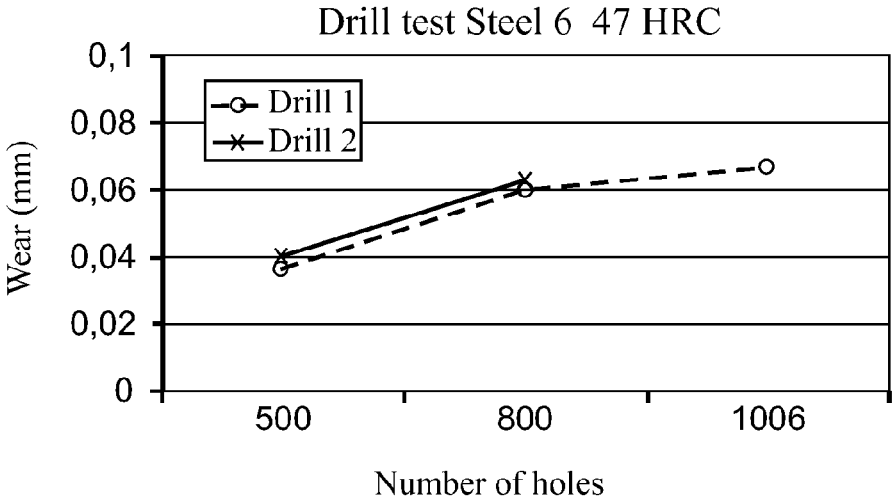
Figure 11A:
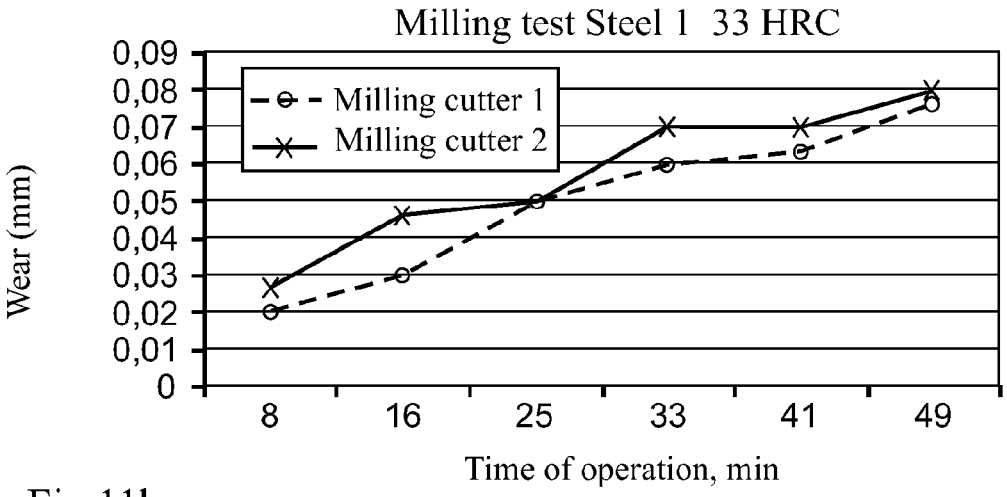
FIGS. 11*a* to *c* show results from end milling tests.
Figure 11B:
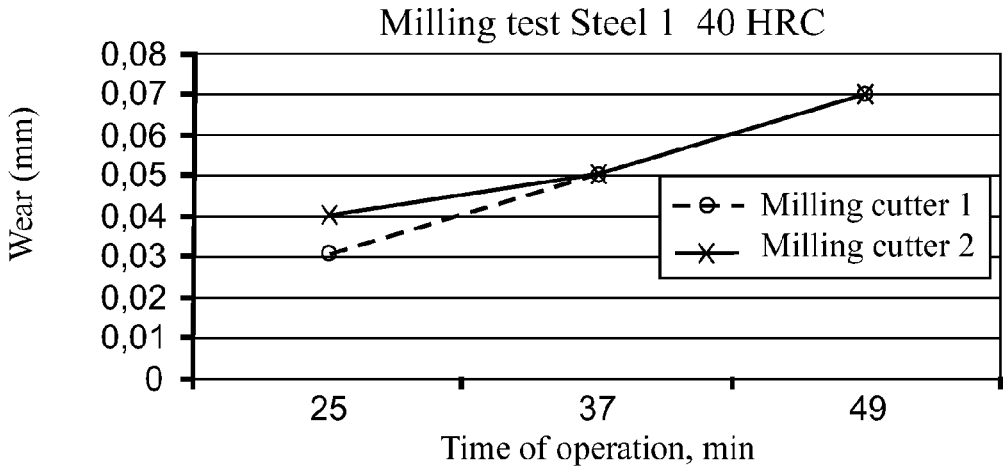
Figure 11C:
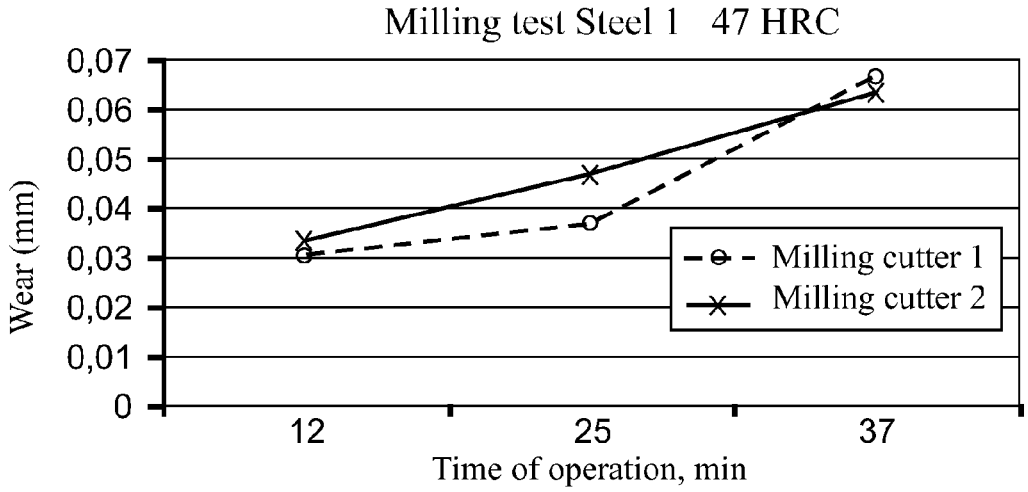
Figure 12A:
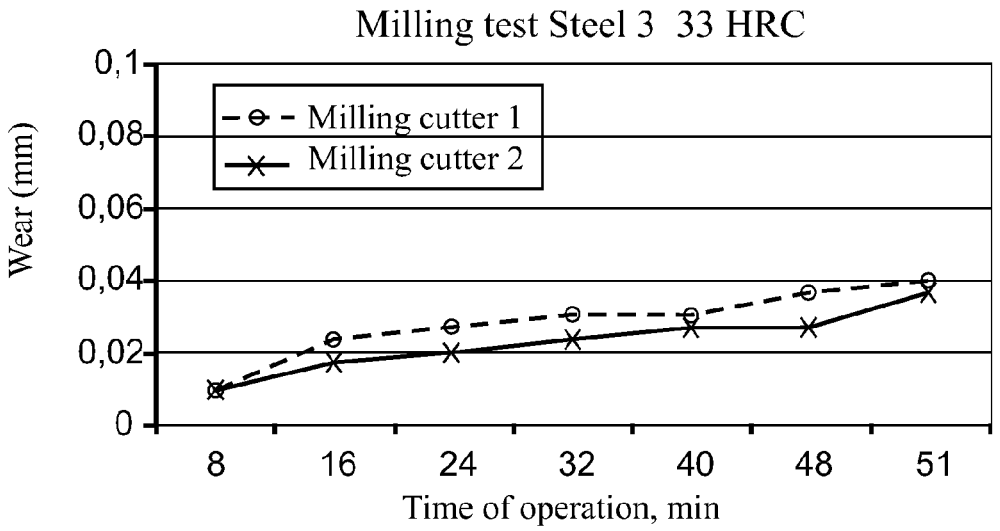
FIGS. 12*a* to *c* show results from end milling tests.
Figure 12B:
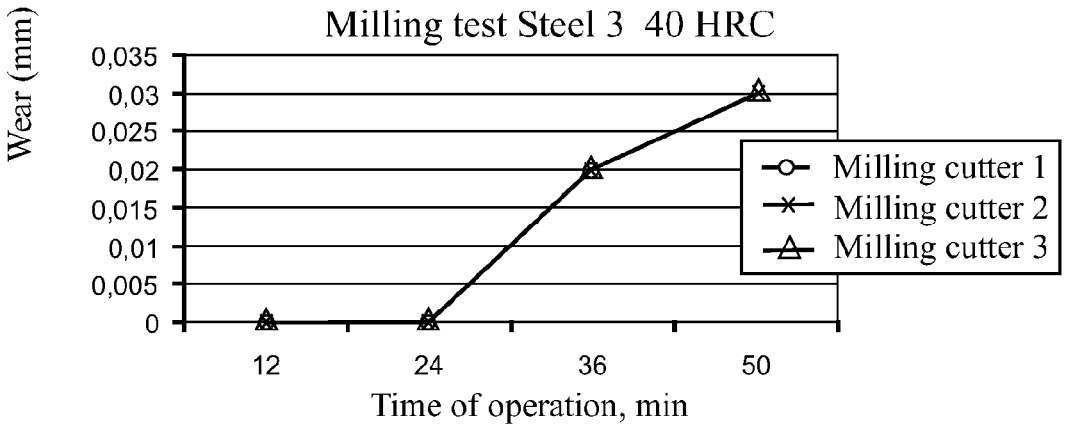
Figure 12C:
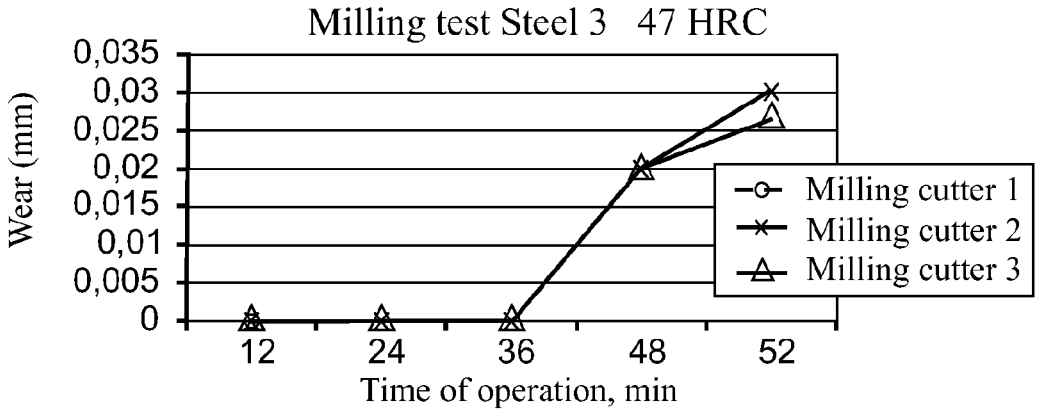
Figure 13A:
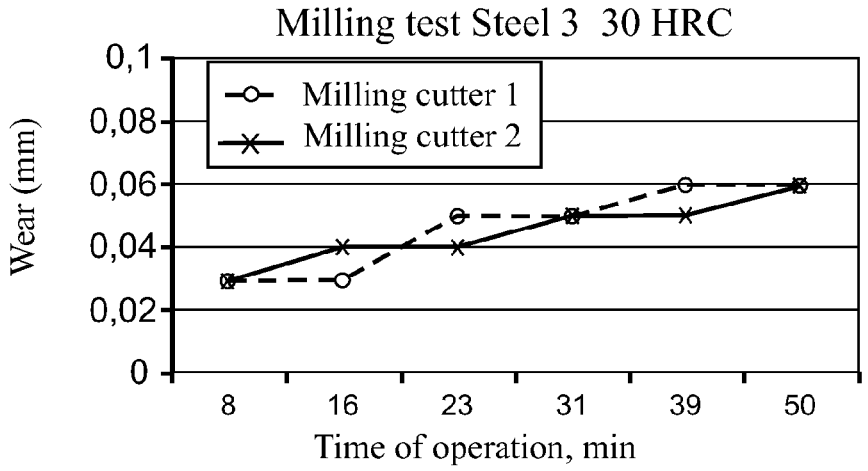
FIGS. 13*a* to *c* show results from end milling tests.
Figure 13B:
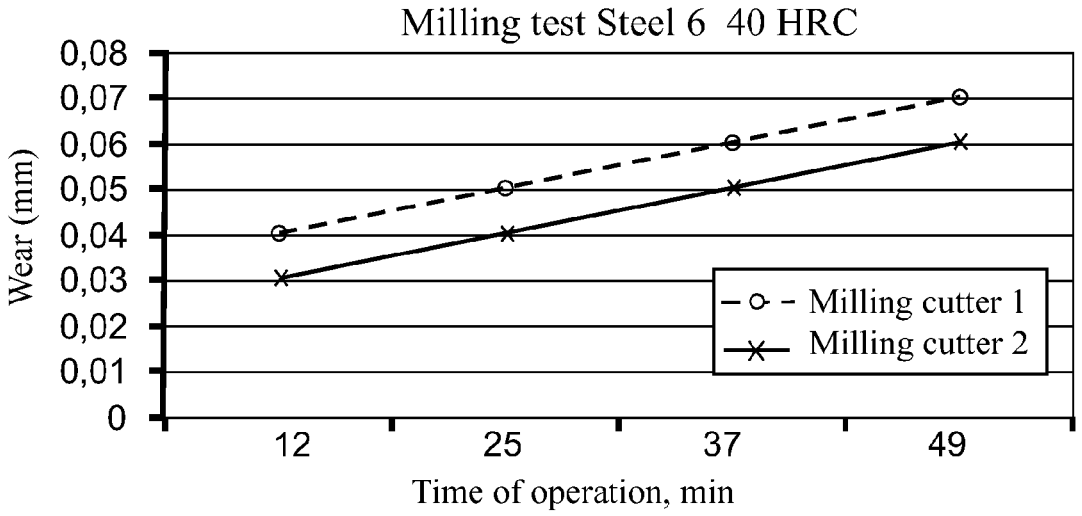
Figure 13C:
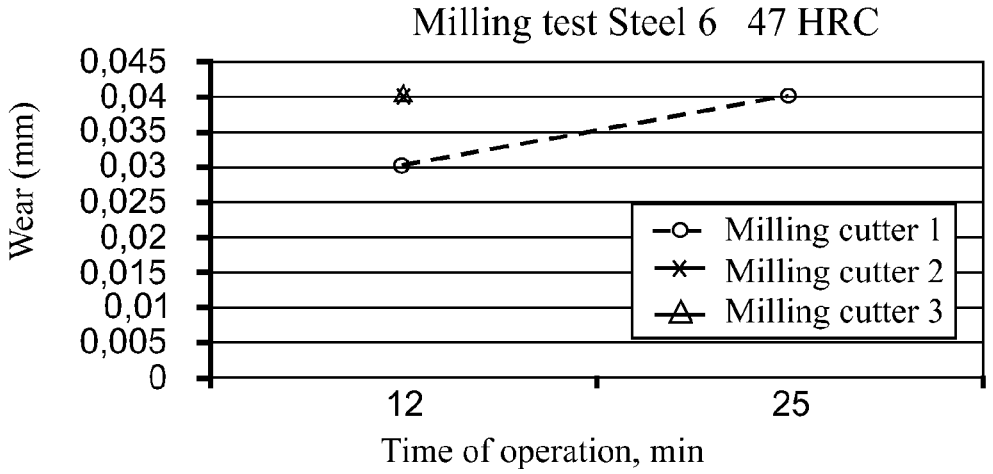

To improve the fatigue strength, compressive stresses may be introduced into the surface of the material. In this regard, the term surface refers to the material in the surface and down to a depth of no residual stresses below the very surface. The depth depends on the surface treatment method. At use at high temperatures, it is important that the material has a good ability to maintain the introduced compressive stresses. The ability of the steel of the invention to maintain these introduced compressive stresses after heating (resistance against relaxation) was examined and compared with the reference materials, which is shown in FIG. 7. The compressive stresses in the material were introduced by shot peening as described above. FIG. 7 shows that the steel (Q9287, steel No. 6) of the invention has a very good ability to maintain the compressive stresses applied. The steel is particularly good in the temperature range 300 to 450° C. where the resistance to relaxation is much higher than for the reference steels. At 350° C. the residual stress in the steel of the invention is approximately 80%, at 400° C. it is approximately 70% and at 450° C. it is approximately 60%. This is better than both of the reference materials where the comparative values at these temperatures are approximately 65%, 55% and 52% for Steel Q9277 and approximately 55%, 40% and 20% for Steel 3. It is also favourable that the residual stresses decrease comparatively evenly. It can also be seen that the inventive steel maintains its stresses at temperatures between 650 deg C. and 700 deg C., in contrast to the reference steels. For example, steel Steel 3 have no residual stresses above 540° C. and steel Q9277 have no residual stresses above 670° C.

Figure 17:
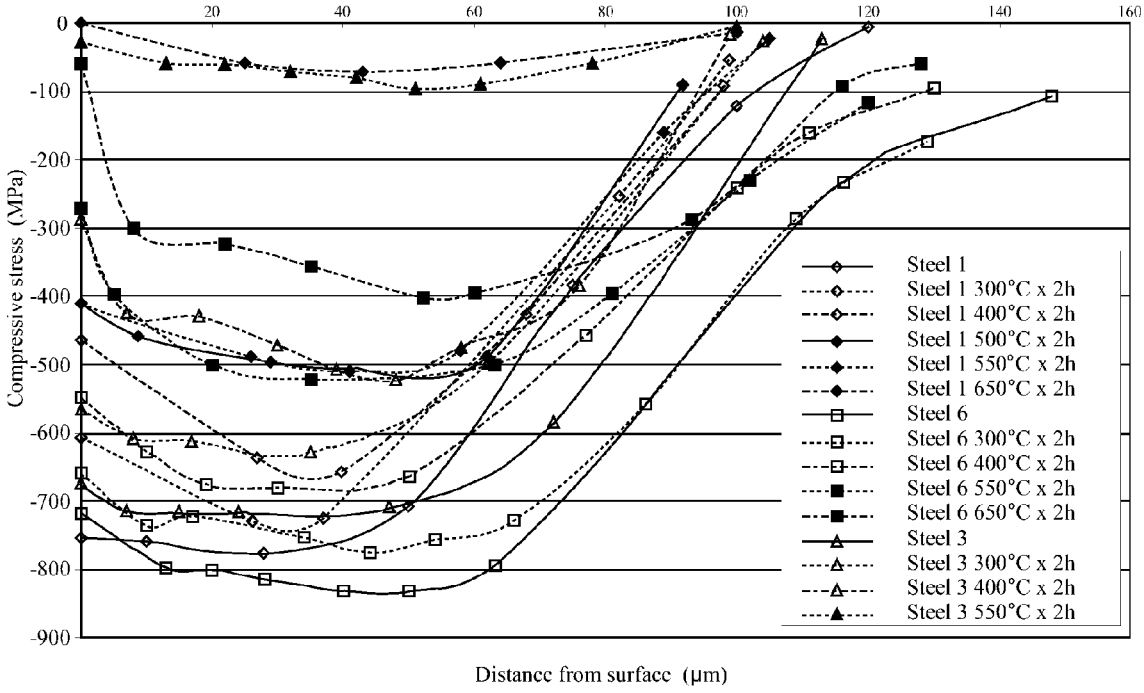
FIG. 17 shows a comparison of the influence of the temperature on the applied compressive stresses.

Further, it was examined how deep the applied compressive stresses could penetrate into the surface of steel No. 6 and the reference materials, as well as which effect the temperature has on the ability of the steel to maintain these compressive stresses. The result is shown in FIG. 17. The comparison shows that the highest compressive stress in the surface may be reached with steel No. 6 and that the compressive stresses penetrate deepest into the surface of this steel. Steel No. 6 also shows the best resistance against relaxation. After heat treatment at 650° C. the maximum compressive stresses in steel 6 is approximately −400 MPa to be compared with approximately −70 MPa for Steel 1. Steel 3 has the least ability to maintain the compressive stresses at high temperatures. After heat treatment at 550° C. the maximum residual compressive stresses in Steel 3 is approximately −100 MPa. From the diagram it can be seen that after heat treatment during 2 hours at 650° C. at least 40% of the introduced compressive stresses remains in the surface (measured at a depth of 50 μm).

Strength

Through tensile tests, the yield point and the ultimate stress of the steel in hardened and tempered condition were examined and compared with the reference materials. The results are shown in Table 4 and this table shows that the steel of the invention has the best ductility, which i.a. is understood by the difference between yield point and ultimate stress being greatest.

The steel of the invention shows a somewhat lower yield point at a comparable hardness, which implies that the steel of the invention is more easily plasticized than the reference materials at tension load. Therefore, the compression resistance of the steels was examined, which is a better measure of the strength of the steel than the yield point at tensile tests for exactly this application. The compression test showed that the steel of the invention had a better compression resistance (Rp 0.2) than the reference materials, which is shown in Table 4.

TABLE 4

| | Tensile test | | | | | Compression |
|---|---|---|---|---|---|---|
| Steel | Hardness (HRC) | Rp 0.2 (MPa) | Rm (MPa) | Elongation A5 (%) | Contraction Z (%) | test Rp 0.2 (MPa) |
| Steel 1 | 45 | 1280 | 1420 | 12 | 55 | 1332 |
| Steel 3 | 43.5 | 1311 | 1450 | 9 | 46 | |
| Steel 3 | 45 | — | — | — | — | 1335 |
| Steel 6 | 43.7 | 1180 | 1416 | 12 | 52 | |
| Steel 6 | 45 | — | — | — | — | 1378 |

Wear Resistance

The wear resistance of the steel in hardened and tempered condition was examined with a pin on disk test, with $SiO_2$ as an abrasive medium, 120 s, dry condition, and the result is shown in Table 5. Among the test alloys Q9277 to Q9280, the steel Q9280 of the invention shows the second best wear resistance. For steel No. 6, manufactured in a full scale, a somewhat inferior abrasive loss than for steel No. 1 was measured, which may partly be explained by the fact that steel No. 6 has a lower hardness. Further, it is noticed that steel No. 6 with a hardness of 44 HRC shows a better wear resistance than Q9280 with a hardness of 45 HRC.

TABLE 5

| Steel | Hardness (HRC) | Abrasive loss (mg/min) |
|---|---|---|
| Q927 | 45 | 235 |
| Q927 | 45 | 260 |
| Q927 | 45 | 185 |
| Q928 | 45 | 200 |
| Steel | 45 | 180 |
| SStee | 45 | 295 |
| Steel | 44 | 220 |

Machinability

Comprehensive tests regarding the machinability have been performed, i.a. by measuring with various treatment methods what wear the tested steels cause on the edges of the cutting tools, which is described below. All tests except the turning test were performed in hardened and tempered condition at various hardnesses. Initially the machinability was examined with the test alloys Q9277 to Q9287, and thereafter the machinability of steel No. 6 was examined and compared with the reference materials Nos. 1 and 6.

The machinability of the steels (Q9277 to Q9287) was examined by measuring the number of drilled holes until failure at two cutting speeds. Table 6 shows that the steels Q9280 and Q9287 as well as steels Nos. 3 and 6 show a very good machinability at twist drilling. The steel Q9286, with an essentially higher hardness, has a machinability in level with the reference material Q9277.

TABLE 6

Twist drilling, drill of high speed steel 120 Wedevåg Ø 2 mm, Wear criterion: Failure, >350 drilled holes at 17 m/min, >500 drilled holes at 20 m/mm.

| | Hardness (HRC) | Number of drilled holes | Cutting speed (m/min) | Feeding mm/ rotation |
|---|---|---|---|---|
| Q9277 | 44 | 108 | 17 | 0.05 |
| Q9278 | 45 | >350 | 17 | 0.05 |
| Q9279 | 44 | 288 | 17 | 0.05 |
| Q9280 | 45 | >350 | 17 | 0.05 |

TABLE 6-continued

Twist drilling, drill of high speed steel 120 Wedevåg Ø 2 mm, Wear criterion: Failure, >350 drilled holes at 17 m/min, >500 drilled holes at 20 m/mm.

| | Hardness (HRC) | Number of drilled holes | Cutting speed (m/min) | Feeding mm/ rotation |
|---|---|---|---|---|
| Q9286 | 47 | 81 | 17 | 0.05 |
| Q9287 | 45 | >350 | 17 | 0.05 |
| Q9278 | 45 | 695 | 20 | 0.05 |
| Q9280 | 45 | 320 | 20 | 0.05 |
| Q9287 | 45 | 280 | 20 | 0.05 |
| Steel 3 | 45 | >500 | 20 | 0.05 |
| Steel 6 | 45 | 410 | 20 | 0.05 |

Figure 15:
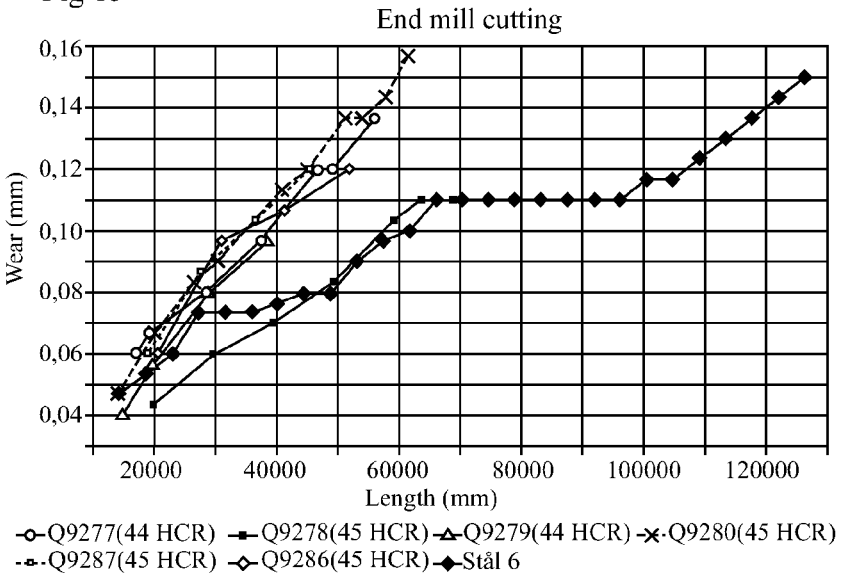
FIG. 15 shows results from end milling.

FIG. 15 shows the results from the end milling tests. The flank wear of the cutting edge was measured in relation to the length which had been milled away. At end milling, which in this case was performed with very small milling cutters, also adherence of material in the chip flute is an expressed problem, which after some time leads to failure of the milling cutter. Among the steels manufactured in a laboratory scale, Q9280 has the best result. The steel fulfilled the requirement of 0.15 mm flank wear without failure. The cut length amounted to 50,000 mm. Steel No. 6, which had been manufactured in a production scale, also managed the requirement for max. 0.15 mm flank wear without failure and was superiorly best with a milled length of 114,000 mm. The other steels failed before they had reached a flank wear of 0.15 mm.

Test data:

Cutting tool: Solid cemented carbide end milling cutter, Ø5 mm

Cutting speed: 100 m/min

Feed: 0.05 mm/tooth

Cutting depth: Ap=4 mm, Ae=2 mm

Criteria: Vbmax=0.15 mm

The machinability was examined with turning tests of materials in a soft-annealed condition at a hardness of 300 HB. For steel No. 6 a $V_{30}$-value of 188 m/min was measured, while steel No. 5 obtained a value of 164 m/min. The $V_{30}$-value is the cutting speed which at turning gives a tool life of 30 min. According to a preferred embodiment of the invention, the steel shall have a V30 value of at least 150 m/min, preferably at least 170 m/min in soft annealed condition.

The machinability of the steel has also been tested through drilling tests, milling tests and thread tests at a manufacturer of cutting tool bodies. The tests are shown in FIGS. 8*a-c* to 14*a-c*. In all, the tests showed that the steel of the invention fulfills the manufacturer's requirements for improved machinability.

FIGS. 8*a-c*, 9*a-c* and 10*a-c* shows the wear that drilling of a certain number of holes generate on the cutting edge of the drill when the machinability of steels Nos. 1, 3 and 6 was examined. The tests showed that steel No. 3 generates the least flank wear, and steel No. 1 was the most difficult to work and resulted in a comparatively quick failure due to chipping at 40 and 47 HRC. The steel No. 6 fulfilled the requirement for at least 1,000 drilled holes and a maximal flank wear of the cutting edge of 0.15 mm at 30 and 40 HRC, and at one of the drilling tests at 47 HRC. Test data:

Cutting tool: Drills of solid cemented carbide, Ø4.3 mm, for 33 HRC

Drills of solid cemented carbide, Ø4.6 mm for 40 and 47 HRC

Cutting speed: 100 m/min for 33 HRC and 50 m/min for 40 HRC and 47 HRC

Feed: 0.18 mm/rev. for 33 HRC and 0.1 mm/rev. for 40 HRC and 47 HRC

Cutting depth: Ap=13 mm

Criteria: Vbmax=0.15 mm, ch≥0.1 mm, drill failure, or 1,000 drilled holes

Cooling: Emulsion Castrol 7% outside

In FIGS. 11*a-c*, 12*a-c* and 13*a-c* is shown the flank wear on the edge of the milling tool generated from milling during a period of operation of 50 min. Also here, steel No. 3 showed the best machinability, while steel No. 6 showed about the same machinability as steel No. 1, but with the difference that at 47 HRC steel No. 1 generated failure due to chipping at 37 min., while steel No. 6 generated failure due to edge breakage at 25 min. Test data:

Cutting tool: Solid cemented carbide end milling cutter, Ø10 mm

Cutting speed: 150 m/min for 33 HRC and 100 m/min for 40 HRC and 47 HRC

Feed: 0.072 mm/tooth

Cutting depth: Ap=6 mm, Ae=3 mm

Criteria: Vbmax=0.1 mm, ch≥0.1 mm, milling cutter failure or 50 min time of operation Square blanks with a maximal length of 150 mm were milled with climb milling and compressed air directed towards the cutting zone.

Figure 14A:
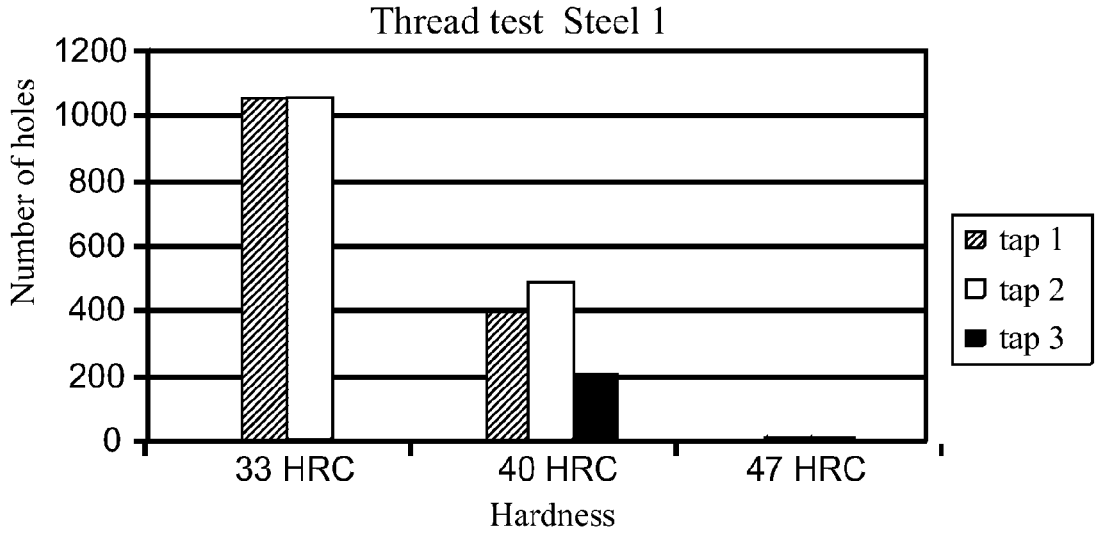
FIGS. 14*a* to *c* show results from thread tests.
Figure 14B:
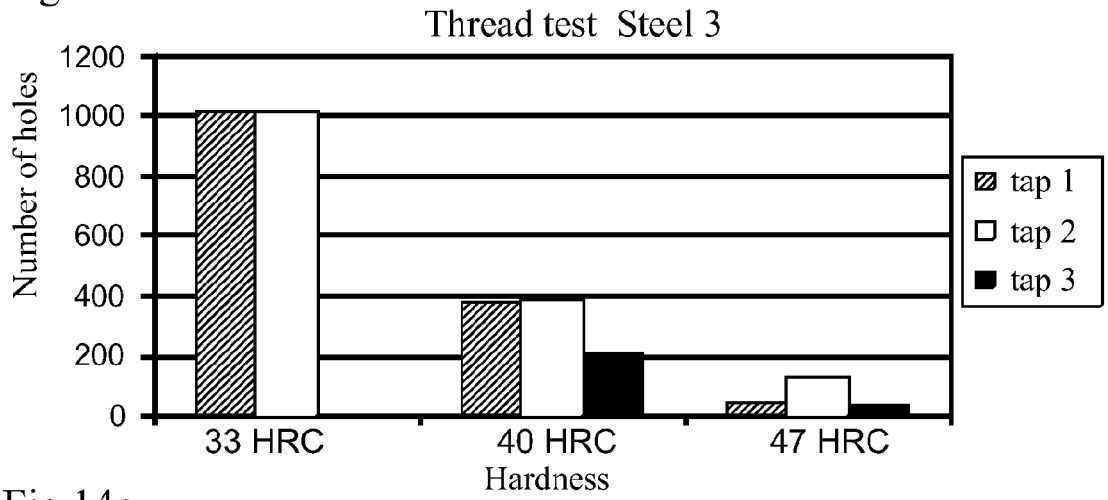
Figure 14C:
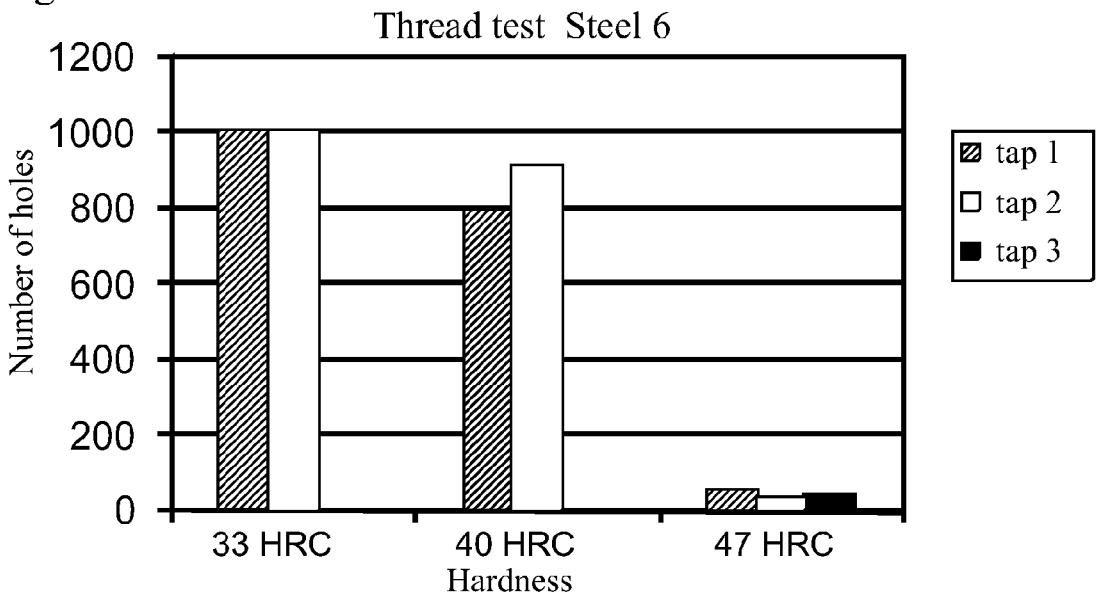

FIGS. 14*a-c* show the results from the thread test. The threading property is one of the absolutely most important properties among the machining properties. Also here, the tests were discontinued at 1,000 threaded holes, which all tested steels managed at a hardness of 33 HRC. From the tests it was verified that steel No. 6 had superiorly good threading properties at a hardness of 40 HRC. At 47 HRC about equivalent properties was measured for steels Nos. 3 and 6, while it was principally impossible to thread steel No. 1 at 47 HRC. Test data:

Cutting tool: Thread tap M5×0.8 steam tempered PWZ Paradur Inox 20 513 for 33 HRC;

Thread tap M5×0.5 uncoated PWZ Paradur Ni 10 26-19310 for 40 HRC and 47 HRC

Cutting speed: 15 m/min for 33 HRC, 4 m/min for 40 HRC and 47 HRC

Revolution feeding 99% of the pitch

Thread depth: Ap=7 mm full thread

Criteria: Thread tap failure or when the tap has been worn so that a full thread of 6.5 mm is reached or if the tap has made 1,000 approved threads.

Cooling: Emulsion Castrol 7%

Figure 16:
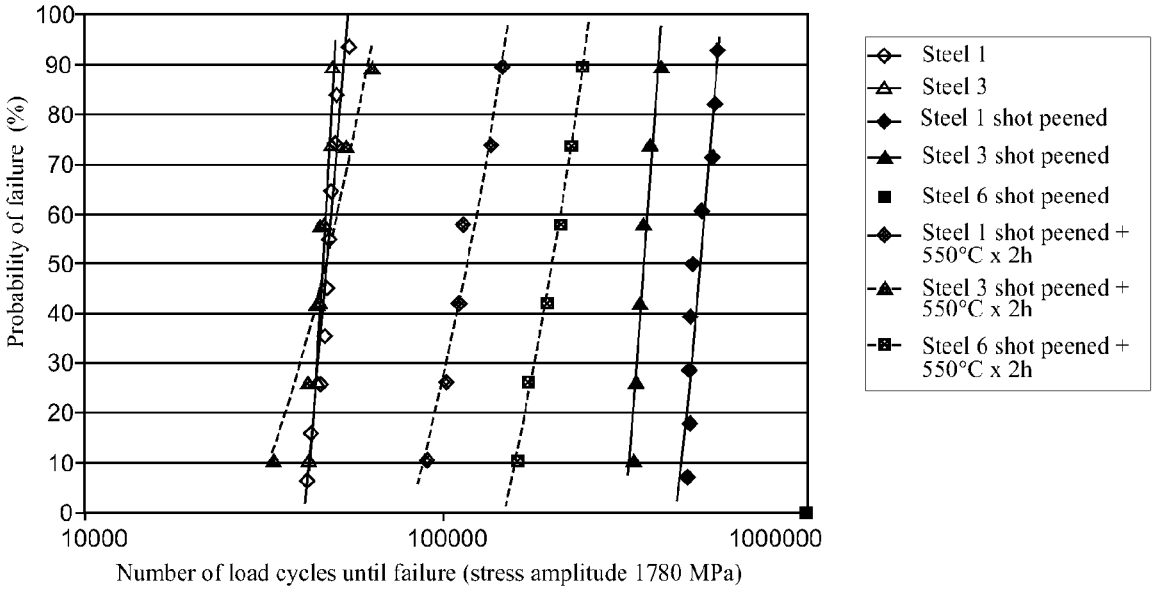
FIG. 16 shows a comparison of the influence of the temperature on the fatigue strength.

Application tests have been performed, where cutting tool bodies have been manufactured from the steel of the invention. The fatigue properties of the cutting tool bodies have been examined by simulating the load cycles arising during operation. A cyclic load of 1780 MPa was applied perpendicularly to the insert pocket on the cutting tool body, i.e. where the insert is mounted. The residual stresses in the corner between the front edge of the insert pocket and its inner supporting lateral wall, a range where fatigue breakages are initiated, were measured with X-ray diffraction. FIG. 16 shows the results from the fatigue test. The examination has been made on cutting tool bodies, which have been shot peened in hardened and tempered condition, as well as on shot peened cutting tool bodies which have been heat treated at 550° C. during 2 h, in order to simulate use. Steels Nos. 1 and 3 have also been examined in hardened and tempered condition only. The examination shows that steel No. 6 has better fatigues properties than both steel No. 1 and steel No. 3.

Production of the Steel

In a process for the production of a steel with a chemical composition according to the invention a steel melt is produced by conventional melt metallurgical manufacturing technique. The melt is cast to ingots by ingot casting, suitably bottom casting. Powder metallurgical manufacture, spray forming or Electro Slag Remelting seem to be needless and are only unnecessarily expensive alternatives. The ingots manufactured were hot worked at a temperature between 800 and 1300° C., preferably 1150 to 1250° C. to desired dimensions through forging and/or hot rolling and are thereafter allowed to cool freely in air to a temperature of 20 to 200° C., preferably 20 to 100° C., wherein a hardening of the steel is obtained. Thereafter, double tempering follows during 2 h (2×2 h) with an intermediate cooling. The tempering is performed either as low temperature tempering from a temperature between 180 and 400° C., preferably 180 to 250° C., or as a high temperature tempering from a temperature between 500 and 700° C. In hardened and tempered condition, a preferred embodiment of the steel has a matrix consisting of tempered martensite with a content of up to about 2 vol.-% of essentially round, evenly distributed carbides, which matrix is essentially void of grain boundary carbide. At low temperature tempering, a steel with high hardness, typically about 50 HRC, and a good toughness is obtained. Low temperature tempering may therefore be advantageous, when the steel is to be used in applications in room temperature, where there are extreme requirements for chipping resistance. High temperature tempering gives the possibility to control the hardness of the steel within the range 34 to 50 HRC. High temperature tempering also results in a steel with lower toughness, but i.a. improved hot hardness and wear resistance. Therefore, high temperature tempering is preferred, if the steel is to be used in applications with increased working temperatures.

In an alternative manufacturing process the steel is soft-annealed, when it has cooled after the hot working. Soft-annealing takes place at a temperature of 650° C. during 10 h. Thereafter, the steel is allowed to cool in a furnace with a temperature reduction of 10° C./h down to 500° C., and thereafter cooling freely in air to room temperature wherein the steel obtains a hardness of about 300 HB. In soft-annealed condition, the steel has a matrix consisting of overaged martensite with a content of up to about 5 vol.-% of essentially round, evenly distributed carbides, which matrix is essentially free from grain boundary carbide. In soft-annealed condition the steel may be worked to a cutting tool body or a holder for cutting tools. Alternatively, an initial machining is made, while the end machining is performed after hardening and tempering. If a higher hardness than 300 HB is desired, the finished work piece may be hardened and tempered, which is possible thanks to the very good hardenability of the steel, which offers slow cooling in air after the austenitizing, which minimizes the risk for deformations. The steel is hardened from an austenitizing temperature between 850 and 1050° C., preferably between 900 and 1020° C. It is advantageous if the austenitizing temperature is kept low, as it counteracts grain growth and the occurrence of residual austenite in the material. In addition, finer carbides are obtained at lower austenitizing temperatures. After hardening a hardness of 45 to 50 HRC is obtained. The tempering is performed to the desired hardness as described above, wherein a matrix is obtained consisting of tempered martensite, which matrix is essentially free from grain boundary carbide and has a content of up to about 2 vol.-% of essentially round, evenly distributed carbides.

Thanks to the invention, a steel is provided which may be manufactured with good production economy, i.a. when a separate hardening operating is not always required, as the steel can be hardened in connection with cooling after hot working. For customers who will manufacture a component of the steel, the good machinability and dimension stability of the steel enable machining of the steel in hardened and tempered condition. This implies that the customer manufacturing a component of the steel needs not invest in equipment for hardening and tempering, alternatively needs not buy that service. In addition, the time for the production of a component is reduced thanks to t.

The customers, who themselves want to harden and temper their material, may order material in a soft-annealed condition. After machining to the desired shape, the product may be austenitized without too specific requirements for the austenitizing temperature, which implies that the customer may harden the product together with products produced of other materials and adapt the austenitizing temperature to the requirement for the other materials. Thereafter, the material is tempered to the desired hardness. If desired, compressive stresses may be introduced into the surface of the finished work piece through shot peening. Certain surfaces may be induction hardened, subjected to nitriding or PVD-coated.

In the first place, the steel has been developed for the use for cutting tool bodies. An important economic advantage from a production viewpoint may be offered to the end user of these cutting tool bodies. Thanks to the very good tempering resistance, it will be possible to use a cutting tool body at higher cutting speeds but with a reduced requirement for cooling of the cutting tool body. This results also in a reduced thermal fatigue of the edge of the carbide insert. In this way, reduced production costs are achieved thanks to both longer life of the cutting tools and higher production rates.

As the steel has an extremely good hardenability, a completely through-hardened product may be obtained at air cooling of very large dimensions, which the dilatometer testing has proved. The hardenability in combination with a very good machinability, a good wear resistance, a good hot hardness and a good compression resistance make the steel suitable for use also for hot work tools and plastic moulding tools. If the steel is to be used for hot work tools or plastic moulding tools with requirements for a good polishability, it may be suitable to supplement the manufacturing process with an Electro Slag Remelting to minimize possible segregations in the material and to obtain a steel which is essentially free from slag inclusions.

The invention claimed is:

1. A steel with a chemical composition consisting essentially of, in weight-%:

0.28 to 0.5 C
0.3 to 1.5% Si
1.0 to 2.0 Mn
max 0.2%
1.5 to 4% Cr
3.0 to 5 Ni
0.7 to 1.0 Mo
0.6 to 1.0 V
from traces to max. 0.4 REM, and
balance of iron, impurities and accessory elements,
wherein the content of residual austenite is limited to 3 vol. %.

2. The steel according to claim 1, wherein the steel consists essentially of max. 0.40 C.

3. The steel according to claim 1, wherein the steel consists essentially of max. 1.5 Mn.

4. The steel according to claim 1, wherein the steel consists essentially of at least 1.9 Cr.

5. The steel according to claim 1, wherein the steel consists essentially of at least 3.8 Ni.

6. The steel according to claim 1, wherein the steel consists essentially of at least 0.75 Mo.

7. The steel according to claim 1, wherein the steel consists essentially of at least 0.7 V.

8. The steel according to claim 1, wherein the steel consists essentially of at least 0.010 S.

9. The steel according to claim 1, wherein the steel consists essentially of 5 to 75 ppm Ca, 10 to 100 ppm O, and 0.003 to 0.020 Al.

10. A steel according to claim 1, wherein the steel has a matrix comprising of martensite with a content of up to about 2 vol.-% of evenly distributed carbides, wherein up to about 1 vol.-% of said carbides is primarily precipitated MC- and $M_6C$-carbides and wherein up to about 1 vol.-% of said carbides is secondary precipitated MC, $M_2C$, and/or $M_3C$ carbides, and which matrix is essentially void of grain boundary carbides.

11. A steel according to claim 1, wherein the steel has a matrix comprising of martensite with a content of up to about 5 vol.-% of essentially round, evenly distributed carbides, which matrix is essentially void of grain boundary carbide.

12. The steel according to claim 1, wherein the steel does not have a ductile-brittle transition temperature at temperatures above −40° C.

13. The steel according to claim 1, wherein the steel has a V30 value of at least 150 m/min in soft annealed condition.

14. The steel according to claim 1, wherein the steel has a tempering resistance providing a reduction in hardness of less than 15 HRC-units after heat treatment during 50 h at 500° C. and 650° C. respectively.

15. A steel according to claim 1, wherein the maximum amplitude compressive stress in the surface is at least 800 MPa after shot peening with steel balls having a hardness of 700 HV at a pressure of 4 bars and that the compressive stresses are introduced to a depth of at least 100 μm.

16. The steel according to claim 1, further consisting essentially of:

0.01 to 0.2 S 0.003 to 0.02 Al 5 to 75 ppm Ca, and 30 to 100 ppm O.

17. The steel according to claim 1, wherein the content of residual austenite is limited to 2 vol. %.

* * * * *